US007488056B2

(12) United States Patent
Torgerson et al.

(10) Patent No.: US 7,488,056 B2
(45) Date of Patent: Feb. 10, 2009

(54) FLUID EJECTION DEVICE

(75) Inventors: Joseph M Torgerson, Philomath, OR (US); Simon Dodd, Cambridge, MA (US); Michael D. Miller, Philomath, OR (US); Trudy L. Benjamin, Portland, OR (US); Kevin Bruce, Corvallis, OR (US)

(73) Assignee: Hewlett--Packard Development Company, L.P., Houston, TX (US)

( * ) Notice: Subject to any disclaimer, the term of this patent is extended or adjusted under 35 U.S.C. 154(b) by 438 days.

(21) Appl. No.: 10/827,030

(22) Filed: Apr. 19, 2004

(65) Prior Publication Data

US 2005/0231562 A1 Oct. 20, 2005

(51) Int. Cl.
*B41J 2/05* (2006.01)

(52) U.S. Cl. ..... 347/58; 347/61; 347/62; 347/59; 347/65

(58) Field of Classification Search ..... 347/19, 347/65, 85, 58, 61, 62, 59
See application file for complete search history.

(56) References Cited

U.S. PATENT DOCUMENTS 5,367,324 A 11/1994 Abe et al.
5,400,063 A 3/1995 Kappel
5,648,804 A 7/1997 Keefe et al.
5,808,640 A * 9/1998 Bhaskar et al. ..... 347/58
6,318,828 B1 11/2001 Barbour et al.
6,398,347 B1 6/2002 Torgerson et al.
6,422,676 B1 7/2002 Torgerson et al.
6,491,377 B1 * 12/2002 Cleland et al. ..... 347/50
6,536,877 B2 3/2003 Miyamoto et al.
6,543,883 B1 4/2003 Dodd et al.
2001/0008411 A1 * 7/2001 Maze et al. ..... 347/64
2002/0093551 A1 * 7/2002 Axtell et al. ..... 347/59
2002/0109755 A1 * 8/2002 Meyer ..... 347/65
2002/0135640 A1 * 9/2002 Chen et al. ..... 347/63
2002/0140772 A1 10/2002 Torgerson et al.
2002/0140779 A1 10/2002 Torgerson et al.
2002/0180839 A1 12/2002 Torgerson et al.
2003/0063161 A1 4/2003 Dodd et al.

* cited by examiner

*Primary Examiner*—Manish S Shah
*Assistant Examiner*—Laura E Martin

(57) ABSTRACT

A fluid ejection device having a first fluid feed source having a first fluid feed source edge in communication with a substrate surface, first firing resistors disposed along the first fluid feed source and configured to respond to a first current to heat fluid provided by the first fluid feed source, and a reference conductor. The reference conductor is configured to conduct the first current from the first firing resistors, wherein the reference conductor is disposed between the first fluid feed source edge and the first firing resistors.

34 Claims, 13 Drawing Sheets

FLUID EJECTION DEVICE

CROSS-REFERENCE TO RELATED APPLICATIONS

This application is related to patent application Ser. No. 10/827,139 entitled "Fluid Ejection Device," patent application Ser. No. 10/827,163, entitled "Fluid Ejection Device With Address Generator," patent application Ser. No. 10/827,045, entitled "Device With Gates Configured In Loop Structures," patent application Ser. No. 10/827,142, entitled "Fluid Ejection Device," and patent application Ser. No. 10/827,135, entitled "Fluid Ejection Device With Identification Cells," each of which are assigned to the Assignee of this application and are filed on even date herewith, and each of which is fully incorporated by reference as if fully set forth herein.

BACKGROUND

An inkjet printing system, as one embodiment of a fluid ejection system, may include a printhead, an ink supply that provides liquid ink to the printhead, and an electronic controller that controls the printhead. The printhead, as one embodiment of a fluid ejection device, ejects ink drops through a plurality of orifices or nozzles. The ink is projected toward a print medium, such as a sheet of paper, to print an image onto the print medium. The nozzles are typically arranged in one or more arrays, such that properly sequenced ejection of ink from the nozzles causes characters or other images to be printed on the print medium as the printhead and the print medium are moved relative to each other.

In a typical thermal inkjet printing system, the printhead ejects ink drops through nozzles by rapidly heating small volumes of ink located in vaporization chambers. The ink is heated with small electric heaters, such as thin film resistors referred to herein as firing resistors. Heating the ink causes the ink to vaporize and be ejected through the nozzles.

To eject one drop of ink, the electronic controller that controls the printhead activates an electrical current from a power supply external to the printhead. The electrical current is passed through a selected firing resistor to heat the ink in a corresponding selected vaporization chamber and eject the ink through a corresponding nozzle. Known drop generators include a firing resistor, a corresponding vaporization chamber, and a corresponding nozzle.

As inkjet printheads have evolved, the number of drop generators in a printhead has increased to improve printing speed and/or quality. The increase in the number of drop generators per printhead has resulted in a corresponding increase in the number of input pads required on a printhead die to energize the increased number of firing resistors. In one type of printhead, each firing resistor is coupled to a corresponding input pad to provide power to energize the firing resistor. One input pad per firing resistor becomes impractical as the number of firing resistors increases.

The number of drop generators per input pad is significantly increased in another type of printhead having primitives. A single power lead provides power to all firing resistors in one primitive. Each firing resistor is coupled in series with the power lead and the drain-source path of a corresponding field effect transistor (FET). The gate of each FET in a primitive is coupled to a separately energizable address lead that is shared by multiple primitives.

Manufacturers continue reducing the number of input pads and increasing the number of drop generators on a printhead die. A printhead with fewer input pads typically costs less than a printhead with more input pads. Also, a printhead with more drop generators typically prints with higher quality and/or printing speed. To maintain costs and provide a particular printing swath height, printhead die size may not significantly change with an increased number of drop generators. As drop generator densities increase and the number of input pads decrease, printhead die layouts can become increasingly complex.

For these and other reasons, there is a need for the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figurees(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
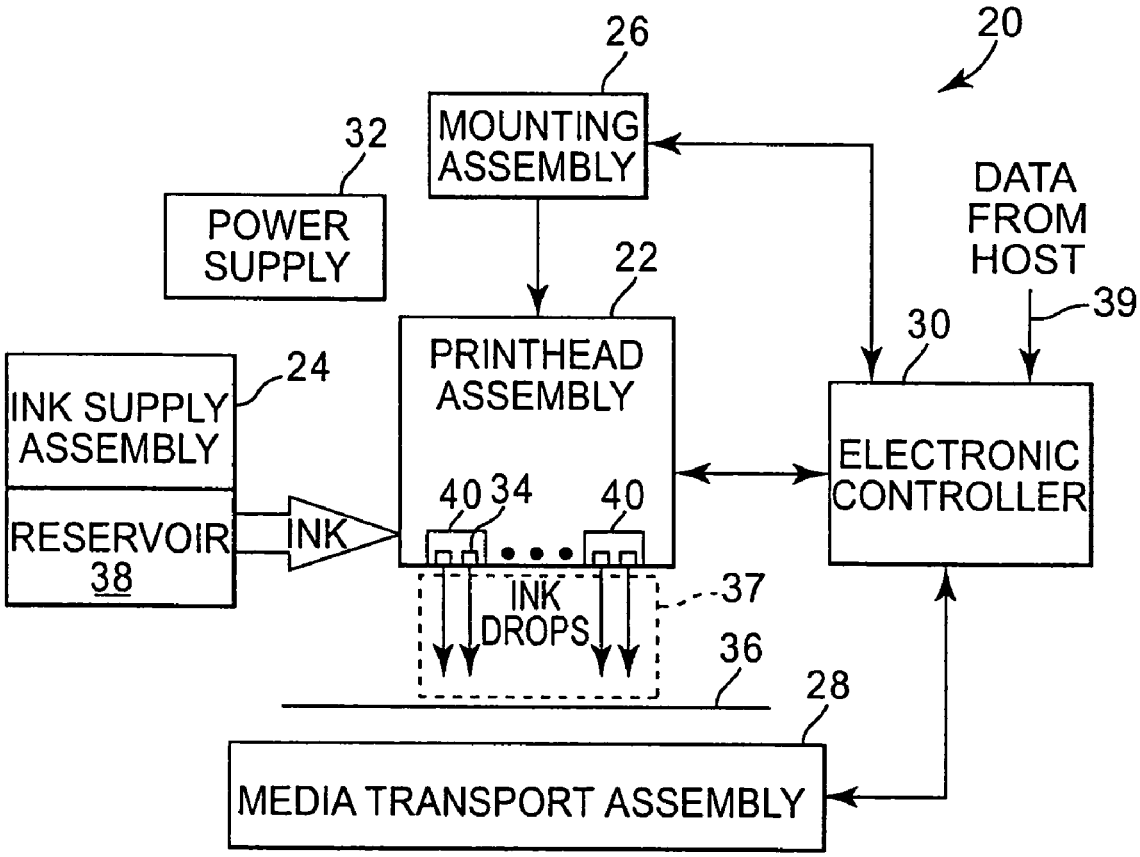
FIG. 1 is a diagram illustrating one embodiment of an inkjet printing system.

FIG. 1 illustrates one embodiment of an inkjet printing system 20. Inkjet printing system 20 constitutes one embodiment of a fluid ejection system that includes a fluid ejection device, such as inkjet printhead assembly 22, and a fluid supply assembly, such as ink supply assembly 24. The inkjet printing system 20 also includes a mounting assembly 26, a media transport assembly 28, and an electronic controller 30. At least one power supply 32 provides power to the various electrical components of inkjet printing system 20.

In one embodiment, inkjet printhead assembly 22 includes at least one printhead or printhead die 40 that ejects drops of ink through a plurality of orifices or nozzles 34 toward a print medium 36 so as to print onto print medium 36. Printhead 40 is one embodiment of a fluid ejection device. Print medium 36 may be any type of suitable sheet material, such as paper, card stock, transparencies, Mylar, fabric, and the like. Typically, nozzles 34 are arranged in one or more columns or arrays such that properly sequenced ejection of ink from nozzles 34 causes characters, symbols, and/or other graphics or images to be printed upon print medium 36 as inkjet printhead assembly 22 and print medium 36 are moved relative to each other. While the following description refers to the ejection of ink from printhead assembly 22, it is understood that other liquids, fluids or flowable materials, including clear fluid, may be ejected from printhead assembly 22.

Ink supply assembly 24 as one embodiment of a fluid supply assembly provides ink to printhead assembly 22 and includes a reservoir 38 for storing ink. As such, ink flows from reservoir 38 to inkjet printhead assembly 22. Ink supply assembly 24 and inkjet printhead assembly 22 can form either a one-way ink delivery system or a recirculating ink delivery system. In a one-way ink delivery system, substantially all of the ink provided to inkjet printhead assembly 22 is consumed during printing. In a recirculating ink delivery system, only a portion of the ink provided to printhead assembly 22 is consumed during printing. As such, ink not consumed during printing is returned to ink supply assembly 24.

In one embodiment, inkjet printhead assembly 22 and ink supply assembly 24 are housed together in an inkjet cartridge or pen. The inkjet cartridge or pen is one embodiment of a fluid ejection device. In another embodiment, ink supply assembly 24 is separate from inkjet printhead assembly 22 and provides ink to inkjet printhead assembly 22 through an interface connection, such as a supply tube (not shown). In either embodiment, reservoir 38 of ink supply assembly 24 may be removed, replaced, and/or refilled. In one embodiment, where inkjet printhead assembly 22 and ink supply assembly 24 are housed together in an inkjet cartridge, reservoir 38 includes a local reservoir located within the cartridge and may also include a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 26 positions inkjet printhead assembly 22 relative to media transport assembly 28 and media transport assembly 28 positions print medium 36 relative to inkjet printhead assembly 22. Thus, a print zone 37 is defined adjacent to nozzles 34 in an area between inkjet printhead assembly 22 and print medium 36. In one embodiment, inkjet printhead assembly 22 is a scanning type printhead assembly. As such, mounting assembly 26 includes a carriage (not shown) for moving inkjet printhead assembly 22 relative to media transport assembly 28 to scan print medium 36. In another embodiment, inkjet printhead assembly 22 is a non-scanning type printhead assembly. As such, mounting assembly 26 fixes inkjet printhead assembly 22 at a prescribed position relative to media transport assembly 28. Thus, media transport assembly 28 positions print medium 36 relative to inkjet printhead assembly 22.

Electronic controller or printer controller 30 typically includes a processor, firmware, and other electronics, or any combination thereof, for communicating with and controlling inkjet printhead assembly 22, mounting assembly 26, and media transport assembly 28. Electronic controller 30 receives data 39 from a host system, such as a computer, and usually includes memory for temporarily storing data 39. Typically, data 39 is sent to inkjet printing system 20 along an electronic, infrared, optical, or other information transfer path. Data 39 represents, for example, a document and/or file to be printed. As such, data 39 forms a print job for inkjet printing system 20 and includes one or more print job commands and/or command parameters.

In one embodiment, electronic controller 30 controls inkjet printhead assembly 22 for ejection of ink drops from nozzles 34. As such, electronic controller 30 defines a pattern of ejected ink drops that form characters, symbols, and/or other graphics or images on print medium 36. The pattern of ejected ink drops is determined by the print job commands and/or command parameters.

In one embodiment, inkjet printhead assembly 22 includes one printhead 40. In another embodiment, inkjet printhead assembly 22 is a wide-array or multi-head printhead assembly. In one wide-array embodiment, inkjet printhead assembly 22 includes a carrier, which carries printhead dies 40, provides electrical communication between printhead dies 40 and electronic controller 30, and provides fluidic communication between printhead dies 40 and ink supply assembly 24.

Figure 2:
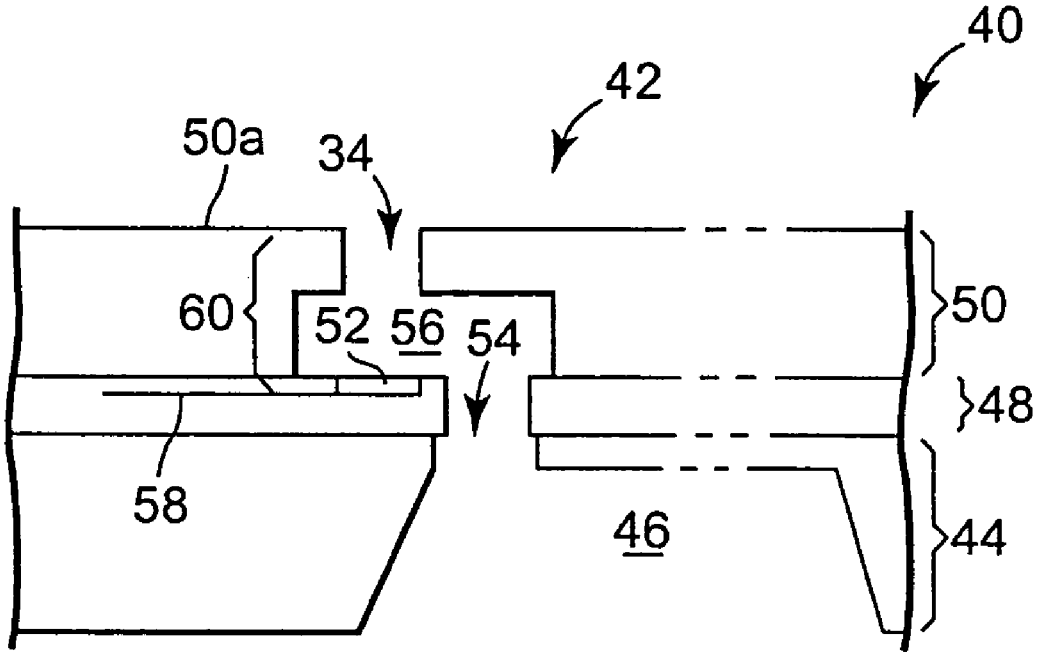
FIG. 2 is a diagram illustrating a portion of one embodiment of a printhead die.

FIG. 2 is a diagram illustrating a portion of one embodiment of a printhead die 40. The printhead die 40 includes an array of printing or fluid ejecting elements 42. Printing elements 42 are formed on a substrate 44, which has an ink feed slot 46 formed therein. As such, ink feed slot 46 provides a supply of liquid ink to printing elements 42. Ink feed slot 46 is one embodiment of a fluid feed source. Other embodiments of fluid feed sources include but are not limited to corresponding individual ink feed holes feeding corresponding vaporization chambers and multiple shorter ink feed trenches that each feed corresponding groups of fluid ejecting elements. A thin-film structure 48 has an ink feed channel 54 formed therein which communicates with ink feed slot 46 formed in substrate 44. An orifice layer 50 has a front face 50*a* and a nozzle opening 34 formed in front face 50*a*. Orifice layer 50 also has a nozzle chamber or vaporization chamber 56 formed therein which communicates with nozzle opening 34 and ink feed channel 54 of thin-film structure 48. A firing resistor 52 is positioned within vaporization chamber 56 and leads 58 electrically couple firing resistor 52 to circuitry controlling the application of electrical current through selected firing resistors. A drop generator 60 as referred to herein includes firing resistor 52, nozzle chamber or vaporization chamber 56 and nozzle opening 34.

During printing, ink flows from ink feed slot 46 to vaporization chamber 56 via ink feed channel 54. Nozzle opening 34 is operatively associated with firing resistor 52 such that droplets of ink within vaporization chamber 56 are ejected through nozzle opening 34 (e.g., substantially normal to the plane of firing resistor 52) and toward print medium 36 upon energizing of firing resistor 52.

Example embodiments of printhead dies 40 include a thermal printhead, a piezoelectric printhead, an electrostatic printhead, or any other type of fluid ejection device known in the art that can be integrated into a multi-layer structure. Substrate 44 is formed, for example, of silicon, glass, ceramic, or a stable polymer and thin-film structure 48 is formed to include one or more passivation or insulation layers of silicon dioxide, silicon carbide, silicon nitride, tantalum, polysilicon glass, or other suitable material. Thin-film structure 48, also, includes at least one conductive layer, which defines firing resistor 52 and leads 58. In one embodiment, the conductive layer comprises, for example, aluminum, gold, tantalum, tantalum-aluminum, or other metal or metal alloy. In one embodiment, firing cell circuitry, such as described in detail below, is implemented in substrate and thin-film layers, such as substrate 44 and thin-film structure 48.

In one embodiment, orifice layer 50 comprises a photoimageable epoxy resin, for example, an epoxy referred to as SU8, marketed by Micro-Chem, Newton, Mass. Exemplary techniques for fabricating orifice layer 50 with SU8 or other polymers are described in detail in U.S. Pat. No. 6,162,589, which is herein incorporated by reference. In one embodiment, orifice layer 50 is formed of two separate layers referred to as a barrier layer (e.g., a dry film photo resist barrier layer) and a metal orifice layer (e.g., a nickel, copper, iron/nickel alloys, palladium, gold, or rhodium layer) formed over the barrier layer. Other suitable materials, however, can be employed to form orifice layer 50.

Figure 3:
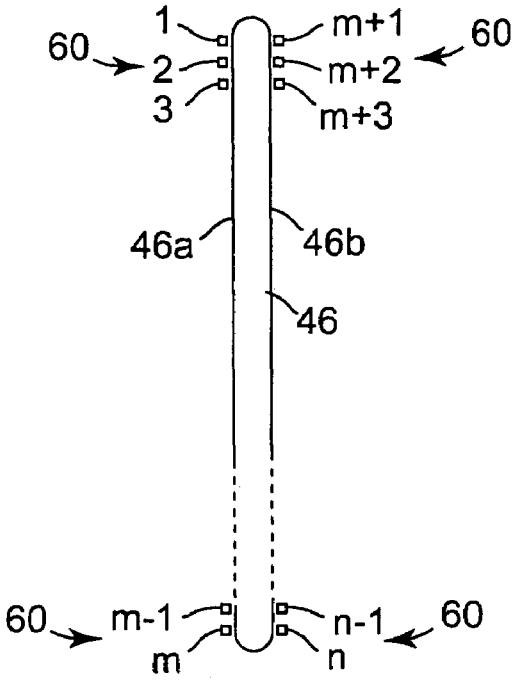
FIG. 3 is a diagram illustrating a layout of drop generators located along an ink feed slot in one embodiment of a printhead die.

FIG. 3 is a diagram illustrating drop generators 60 located along ink feed slot 46 in one embodiment of printhead die 40. Ink feed slot 46 includes opposing ink feed slot sides 46*a* and 46*b*. Drop generators 60 are disposed along each of the opposing ink feed slot sides 46*a* and 46*b*. A total of n drop generators 60 are located along ink feed slot 46, with m drop generators 60 located along ink feed slot side 46*a*, and n−m drop generators 60 located along ink feed slot side 46*b*. In one embodiment, n equals 200 drop generators 60 located along ink feed slot 46 and m equals 100 drop generators 60 located along each of the opposing ink feed slot sides 46*a* and 46*b*. In other embodiments, any suitable number of drop generators 60 can be disposed along ink feed slot 46.

Ink feed slot 46 provides ink to each of the n drop generators 60 disposed along ink feed slot 46. Each of the n drop generators 60 includes a firing resistor 52, a vaporization chamber 56 and a nozzle 34. Each of the n vaporization chambers 56 is fluidically coupled to ink feed slot 46 through at least one ink feed channel 54. The firing resistors 52 of drop generators 60 are energized in a controlled sequence to eject fluid from vaporization chambers 56 and through nozzles 34 to print an image on print medium 36.

Figure 4:
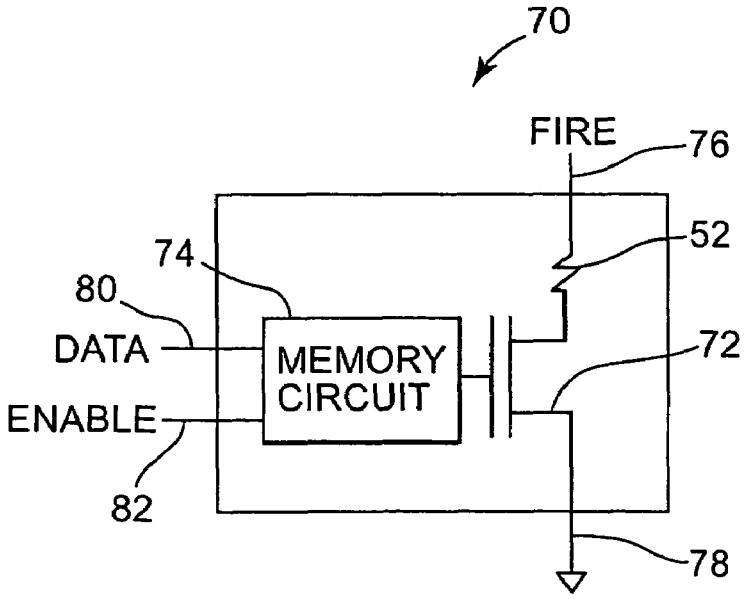
FIG. 4 is a diagram illustrating one embodiment of a firing cell employed in one embodiment of a printhead die.

FIG. 4 is a diagram illustrating one embodiment of a firing cell 70 employed in one embodiment of printhead die 40. Firing cell 70 includes a firing resistor 52, a resistor drive switch 72, and a memory circuit 74. Firing resistor 52 is part of a drop generator 60. Drive switch 72 and memory circuit 74 are part of the circuitry that controls the application of electrical current through firing resistor 52. Firing cell 70 is formed in thin-film structure 48 and on substrate 44.

In one embodiment, firing resistor 52 is a thin-film resistor and drive switch 72 is a field effect transistor (FET). Firing resistor 52 is electrically coupled to a fire line 76 and the drain-source path of drive switch 72. The drain-source path of drive switch 72 is also electrically coupled to a reference line 78 that is coupled to a reference voltage, such as ground. The gate of drive switch 72 is electrically coupled to memory circuit 74 that controls the state of drive switch 72.

Memory circuit 74 is electrically coupled to a data line 80 and enable lines 82. Data line 80 receives a data signal that represents part of an image and enable lines 82 receive enable signals to control operation of memory circuit 74. Memory circuit 74 stores one bit of data as it is enabled by the enable signals. The logic level of the stored data bit sets the state (e.g., on or off, conducting or non-conducting) of drive switch 72. The enable signals can include one or more select signals and one or more address signals.

Fire line 76 receives an energy signal comprising energy pulses and provides an energy pulse to firing resistor 52. In one embodiment, the energy pulses are provided by electronic controller 30 to have timed starting times and timed duration to provide a proper amount of energy to heat and vaporize fluid in the vaporization chamber 56 of a drop generator 60. If drive switch 72 is on (conducting), the energy pulse heats firing resistor 52 to heat and eject fluid from drop generator 60. If drive switch 72 is off (non-conducting), the energy pulse does not heat firing resistor 52 and the fluid remains in drop generator 60.

Figure 5:
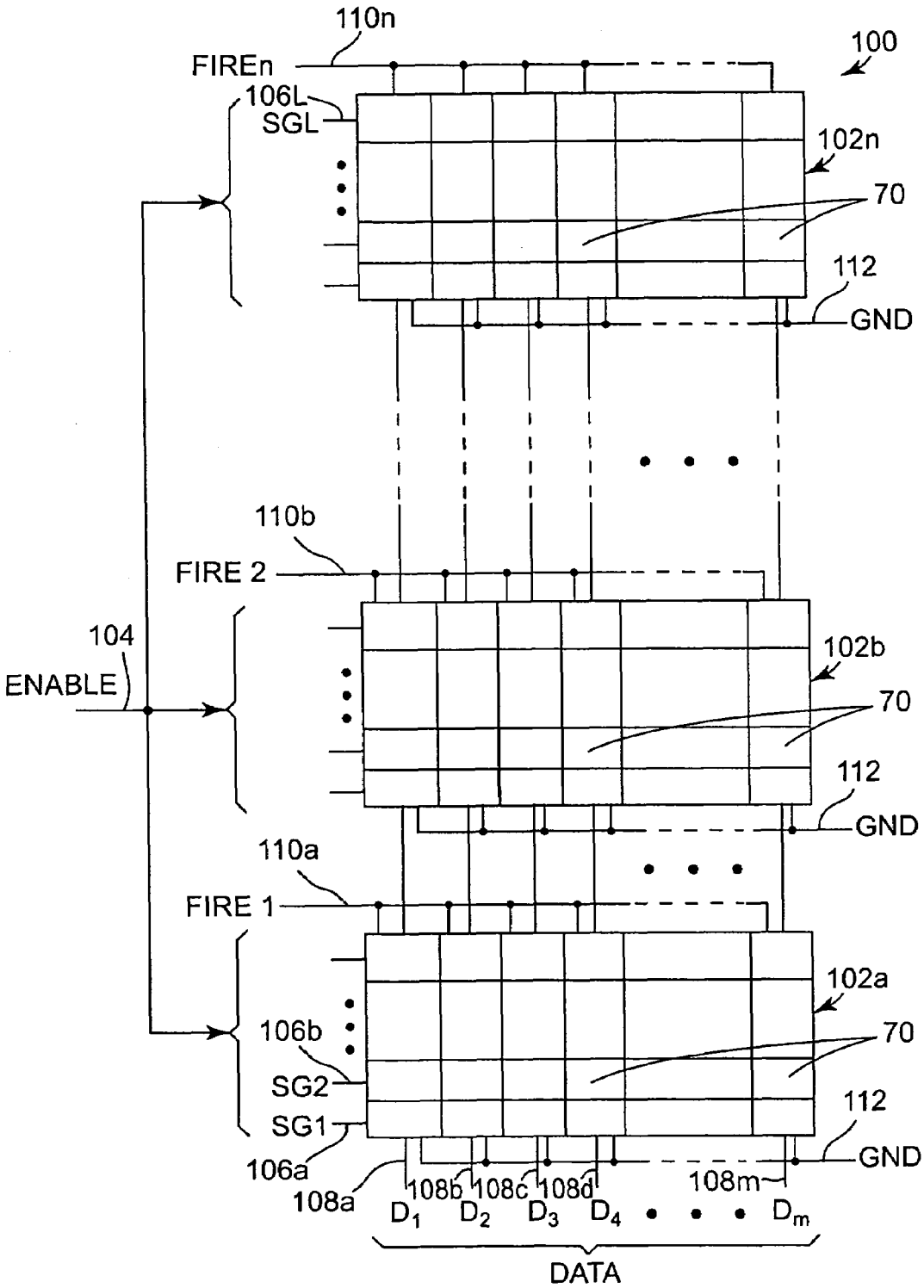
FIG. 5 is a schematic diagram illustrating one embodiment of an inkjet printhead firing cell array.

FIG. 5 is a schematic diagram illustrating one embodiment of an inkjet printhead firing cell array, indicated at 100. Firing cell array 100 includes a plurality of firing cells 70 arranged into n fire groups 102*a*-102*n*. In one embodiment, firing cells 70 are arranged into six fire groups 102*a*-102*n*. In other embodiments, firing cells 70 can be arranged into any suitable number of fire groups 102*a*-102*n*, such as four or more fire groups 102*a*-102*n*.

The firing cells 70 in array 100 are schematically arranged into L rows and m columns. The L rows of firing cells 70 are electrically coupled to enable lines 104 that receive enable signals. Each row of firing cells 70, referred to herein as a row subgroup or subgroup of firing cells 70, is electrically coupled to one set of subgroup enable lines 106*a*-106L. The subgroup enable lines 106*a*-106L receive subgroup enable signals SG1, SG2, . . . $SG_L$ that enable the corresponding subgroup of firing cells 70.

The m columns are electrically coupled to m data lines 108*a*-108*m* that receive data signals D1, D2 . . . Dm, respectively. Each of the m columns includes firing cells 70 in each of the n fire groups 102*a*-102*n* and each column of firing cells 70, referred to herein as a data line group or data group, is electrically coupled to one of the data lines 108*a*-108*m*. In other words, each of the data lines 108*a*-108*m* is electrically coupled to each of the firing cells 70 in one column, including firing cells 70 in each of the fire groups 102*a*-102*n*. For example, data line 108*a* is electrically coupled to each of the firing cells 70 in the far left column, including firing cells 70 in each of the fire groups 102*a*-102*n*. Data line 108*b* is electrically coupled to each of the firing cells 70 in the adjacent column and so on, over to and including data line 108*m* that is electrically coupled to each of the firing cells 70 in the far right column, including firing cells 70 in each of the fire groups 102*a*-102*n*.

In one embodiment, array 100 is arranged into six fire groups 102*a*-102*n* and each of the six fire groups 102*a*-102*n* include 13 subgroups and eight data line groups. In other embodiments, array 100 can be arranged into any suitable number of fire groups 102*a*-102*n* and into any suitable number of subgroups and data line groups. In any embodiment, fire groups 102*a*-102*n* are not limited to having the same number of subgroups and data line groups. Instead, each of the fire groups 102*a*-102*n* can have a different number of subgroups and/or data line groups as compared to any other fire group 102*a*-102*n*. In addition, each subgroup can have a different number of firing cells 70 as compared to any other subgroup, and each data line group can have a different number of firing cells 70 as compared to any other data line group.

The firing cells 70 in each of the fire groups 102*a*-102*n* are electrically coupled to one of the fire lines 110*a*-110*n*. In fire group 102*a*, each of the firing cells 70 is electrically coupled to fire line 110*a* that receives fire signal or energy signal FIRE 1. In fire group 102*b*, each of the firing cells 70 is electrically coupled to fire line 110*b* that receives fire signal or energy signal FIRE 2 and so on, up to and including fire group 102*n* wherein each of the firing cells 70 is electrically coupled to fire line 110*n* that receives fire signal or energy signal FIREn. In addition, each of the firing cells 70 in each of the fire groups 102*a*-102*n* is electrically coupled to a common reference line 112 that is tied to ground.

In operation, subgroup enable signals SG1, SG2, . . . $SG_L$ are provided on subgroup enable lines 106*a*-106L to enable one subgroup of firing cells 70. The enabled firing cells 70 store data signals D1, D2 . . . Dm provided on data lines 108*a*-108*m*. The data signals D1, D2 . . . Dm are stored in memory circuits 74 of enabled firing cells 70. Each of the stored data signals D1, D2 . . . Dm sets the state of drive switch 72 in one of the enabled firing cells 70. The drive switch 72 is set to conduct or not conduct based on the stored data signal value.

After the states of the selected drive switches 72 are set, an energy signal FIRE 1-FIREn is provided on the fire line 110*a*-110*n* corresponding to the fire group 102*a*-102*n* that includes the selected subgroup of firing cells 70. The energy signal FIRE 1-FIREn includes an energy pulse. The energy pulse is provided on the selected fire line 110*a*-110*n* to energize firing resistors 52 in firing cells 70 that have conducting drive switches 72. The energized firing resistors 52 heat and eject ink onto print medium 36 to print an image represented by data signals D1, D2 . . . Dm. The process of enabling a subgroup of firing cells 70, storing data signals D1, D2 . . . Dm in the enabled subgroup and providing an energy signal FIRE 1-FIREn to energize firing resistors 52 in the enabled subgroup continues until printing stops.

In one embodiment, as an energy signal FIRE 1-FIREn is provided to a selected fire group 102*a*-102*n*, subgroup enable signals SG1, SG2, . . . $SG_L$ change to select and enable another subgroup in a different fire group 102*a*-102*n*. The newly enabled subgroup stores data signals D1, D2 . . . Dm provided on data lines 108*a*-108*m* and an energy signal FIRE 1-FIREn is provided on one of the fire lines 110*a*-110*n* to energize firing resistors 52 in the newly enabled firing cells 70. At any one time, only one subgroup of firing cells 70 is enabled by subgroup enable signals SG1, SG2, . . . $SG_L$ to store data signals D1, D2 . . . Dm provided on data lines 108*a*-108*m*. In this aspect, data signals D1, D2 . . . Dm on data lines 108*a*-108*m* are timed division multiplexed data signals. Also, only one subgroup in a selected fire group 102*a*-102*n* includes drive switches 72 that are set to conduct while an energy signal FIRE 1-FIREn is provided to the selected fire group 102*a*-102*n*. However, energy signals FIRE 1-FIREn provided to different fire groups 102*a*-102*n* can and do overlap.

Figure 6:
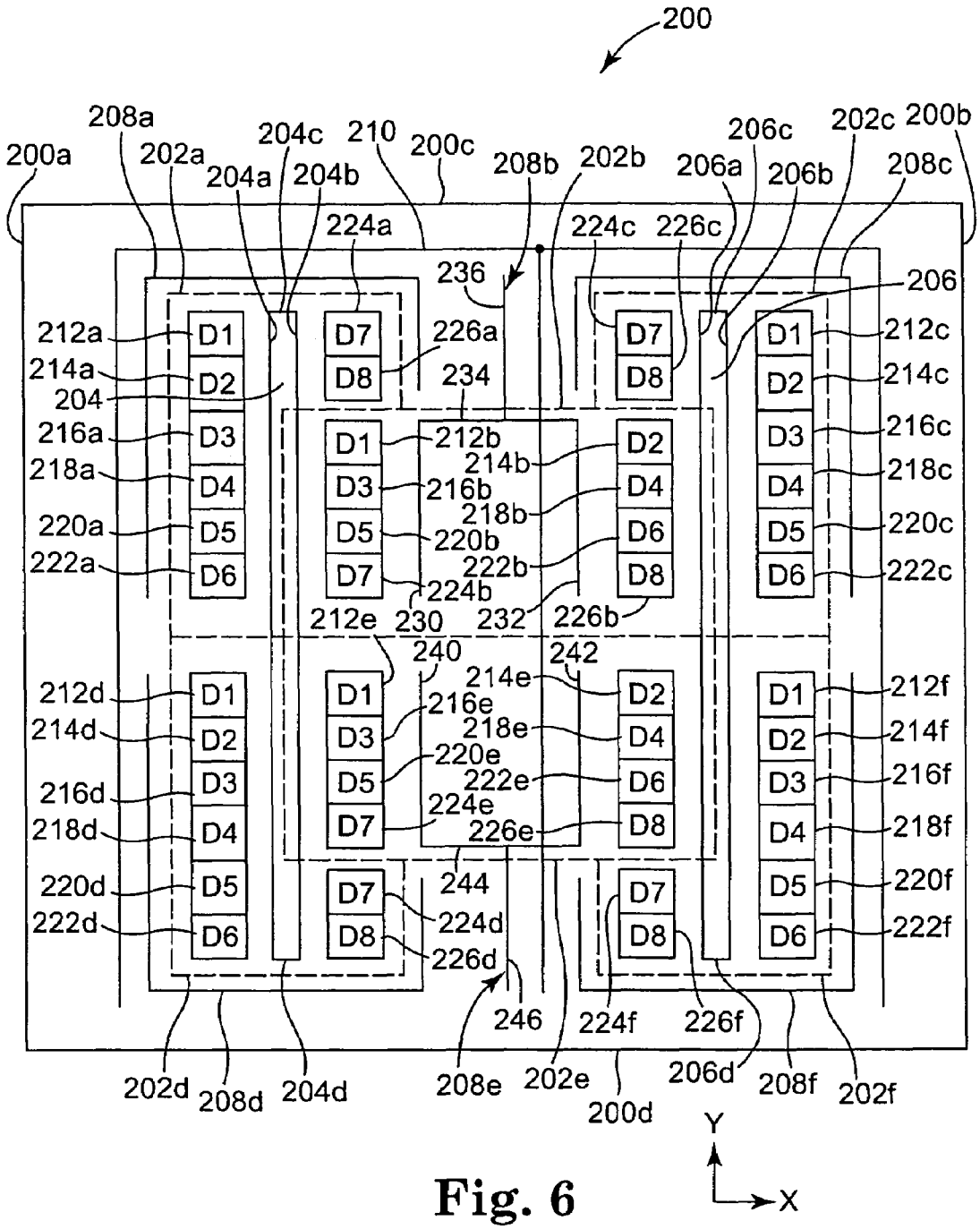
FIG. 6 is a block diagram illustrating one embodiment of a layout of a printhead die.

FIG. 6 is a block diagram illustrating one embodiment of a layout of printhead die 200. The printhead die 200 includes six fire groups 202*a*-202*f*, two ink feed slots 204 and 206, six fire lines 208*a*-208*f* and enable lines 210. The fire lines 208*a*-208*f* correspond to fire groups 202*a*-202*f*, respectively. The enable lines 210 provide subgroup enable signals SG1, SG2, . . . $SG_L$ to fire groups 202*a*-202*f* to enable selected row subgroups.

The six fire groups 202*a*-202*f* are disposed along ink feed slots 204 and 206. Fire groups 202*a* and 202*d* are disposed along ink feed slot 204, and fire groups 202*c* and 202*f* are disposed along ink feed slot 206. The fire groups 202*b* and 202*e* are disposed along both ink feed slots 204 and 206. The ink feed slots 204 and 206 are located parallel to one another and each ink feed slot 204 and 206 includes a length that extends along the y-direction of printhead die 200. In one embodiment, ink feed slots 204 and 206 supply the same color ink, such as black, yellow, magenta or cyan colored ink, to drop generators 60 in fire groups 202*a*-202*f*. In other embodiments, each of the ink feed slots 204 and 206 supplies a different color ink to the drop generators 60.

The fire groups 202*a*-202*f* are divided into eight data line groups, indicated at D1-D8. Each data line group D1-D8 includes firing cells 70 from each of the six fire groups 202*a*-202*f*. Each of the firing cells 70 in a data line group D1-D8 is electrically coupled to a corresponding one of the eight data lines 108*a*-108*h* (FIG. 5). Data line group D1, indicated at 212*a*-212*f*, includes firing cells 70 electrically coupled to data line 108*a*. Data line group D2, indicated at 214*a*-214*f*, includes firing cells 70 electrically coupled to data line 108*b*. Data line group D3, indicated at 216*a*-216*f*, includes firing cells 70 electrically coupled to data line 108*c*. Data line group D4, indicated at 218*a*-218*f*, includes firing cells 70 electrically coupled to data line 108*d*. Data line group D5, indicated at 220*a*-220*f*, includes firing cells 70 electrically coupled to data line 108*e*. Data line group D6, indicated at 222*a*-222*f*, includes firing cells 70 electrically coupled to data line 108*f*. Data line group D7, indicated at 224*a*-224*f*, includes firing cells 70 electrically coupled to data line 108*g*, and data line group D8, indicated at 226*a*-226*f*, includes firing cells 70 electrically coupled to data line 108*h*. Each of the firing cells 70 in printhead die 200 is electrically coupled to only one data line 108*a*-108*h*, and each data line 108*a*-108*h* is electrically coupled to all memory circuits 74 in firing cells 70 of the corresponding data line group D1-D8.

Fire group 1 (FG1) 202*a* is disposed along a first part of ink feed slot 204. The ink feed slot 204 includes opposing ink feed slot sides 204*a* and 204*b* that extend along the y-direction of printhead die 200. The firing cells 70 in printhead die 200 include firing resistors 52 that are part of drop generators 60. The drop generators 60 in FG1 at 202*a* are disposed along each of the opposing sides 204*a* and 204*b* of ink feed slot 204. The drop generators 60 in FG1 at 202*a* are fluidically coupled to ink feed slot 204 to receive ink from ink feed slot 204.

Drop generators 60 in data line groups D1-D6, indicated at 212*a*, 214*a* , 216*a*, 218*a*, 220*a* and 222*a* in FG1 at 202*a* are disposed along one side 204*a* of ink feed slot 204. Drop generators 60 in data line groups D7 and D8, indicated at 224*a* and 226*a*, are disposed along the opposing side 204*b* of ink feed slot 204. The drop generators 60 in data line groups D1-D6 at 212*a*, 214*a* , 216*a*, 218*a*, 220*a* and 222*a* are disposed between one side 200*a* of printhead die 200 and ink feed slot 204. The drop generators 60 in data line groups D7 and D8 at 224*a* and 226*a* are disposed along an inside channel of printhead die 200 between ink feed slot 204 and ink feed slot 206.

In one embodiment, drop generators 60 in data line groups D1-D6 at 212*a*, 214*a* , 216*a*, 218*a*, 220*a* and 222*a* are located along the length of side 204*a* of ink feed slot 204, such that data line group D1 at 212*a* is next to data line group D2 at 214*a* , which is between data line D1 at 212*a* and data line group D3 at 216*a*. Data line group D4 at 218*a* is between data line group D3 at 216*a* and data line group D5 at 220*a*. Data line group D6 at 222*a* is next to data line group D5 at 220*a*. Drop generators 60 in data line groups D7 and D8 at 224*a* and 226*a* are located along the opposing side 204*b* of ink feed slot 204, such that data line group D1 at 212*a* is opposite data line group D7 at 224*a* and data line group D2 at 214*a* is opposite data line group D8 at 226*a*.

Fire group 4 (FG4) 202*d* is disposed along a second part of ink feed slot 204. The drop generators 60 in FG4 at 202*d* are disposed along each of the opposing sides 204*a* and 204*b* of ink feed slot 204 and fluidically coupled to ink feed slot 204 to receive ink from ink feed slot 204. Drop generators 60 in data line groups D1-D6, indicated at 212*d*, 214*d*, 216*d*, 218*d*, 220*d* and 222*d* are disposed along one side 204*a* of ink feed slot 204. Drop generators 60 in data line groups D7 and D8, indicated at 224*d* and 226*d*, are disposed along the opposing side 204*b* of ink feed slot 204. The drop generators 60 in data line groups D1-D6 at 212*d*, 214*d*, 216*d*, 218*d*, 220*d* and 222*d* are disposed between one side 200*a* of printhead die 200 and ink feed slot 204. Drop generators 60 in data line groups D7 and D8 at 224*d* and 226*d* are disposed along an inside channel of printhead die 200 between ink feed slot 204 and ink feed slot 206.

In one embodiment, drop generators 60 in data line groups D1-D6 at 212*d*, 214*d*, 216*d*, 218*d*, 220*d* and 222*d* are located along the length of one side 204*a* of ink feed slot 204, such that data line group D1 at 212*d* is next to data line group D2 at 214*d*, which is between data line group D1 at 212*d* and data line group D3 at 216*d*. Data line group D4 at 218*d* is between data line group D3 at 216*d* and data line group D5 at 220*d*. Data line group D6 at 222*d* is next to data line group D5 at 220*d*. Drop generators 60 in data line groups D7 and D8 at 224*d* and 226*d* are located along the opposing side 204*b* of ink feed slot 204, such that data line group D5 at 220*d* is opposite data line group D7 at 224*d* and data line group D6 at 222*d* is opposite data line group D8 at 226*d*.

Fire group 3 (FG3) 202*c* is disposed along a first part of ink feed slot 206. The ink feed slot 206 includes opposing ink feed slot sides 206*a* and 206*b* that extend along the y-direction of printhead die 200. The firing cells 70 in printhead die 200 include firing resistors 52 that are part of drop generators 60. The drop generators 60 in FG3 at 202*c* are disposed along each of the opposing sides 206*a* and 206*b* of ink feed slot 206. The drop generators 60 in FG3 at 202*c* are fluidically coupled to ink feed slot 206 to receive ink from ink feed slot 206.

Drop generators 60 in data line groups D1-D6, indicated at 212*c*, 214*c*, 216*c*, 218*c*, 220*c* and 222*c* in FG3 at 202*c* are disposed along one side 206*b* of ink feed slot 206. Drop generators 60 in data line groups D7 and D8, indicated at 224*c* and 226*c*, are disposed along the opposing side 206*a* of ink feed slot 206. The drop generators 60 in data line groups D1-D6 at 212*c*, 214*c*, 216*c*, 218*c*, 220*c* and 222*c* are disposed between one side 200*b* of printhead die 200 and ink feed slot 206. The drop generators 60 in data line groups D7 and D8 at 224*c* and 226*c* are disposed along an inside channel of printhead die 200 between ink feed slot 204 and ink feed slot 206.

In one embodiment, drop generators 60 in data line groups D1-D6 at 212*c*, 214*c*, 216*c*, 218*c*, 220*c* and 222*c* are located along the length of side 206*b* of ink feed slot 206, such that data line group D1 at 212*c* is next to data line group D2 at 214*c*, which is between data line D1 at 212*c* and data line group D3 at 216*c*. Data line group D4 at 218*c* is between data line group D3 at 216*c* and data line group D5 at 220*c*. Data line group D6 at 222*c* is next to data line group D5 at 220*c*. Drop generators 60 in data line groups D7 and D8 at 224*c* and 226*c* are located along the opposing side 206*a* of ink feed slot 206, such that data line group D1 at 212*c* is opposite data line group D7 at 224*c* and data line group D2 at 214*c* is opposite data line group D8 at 226*c*.

Fire group 6 (FG6) 202*f* is disposed along a second part of ink feed slot 206. The drop generators 60 in FG6 at 202*f* are disposed along each of the opposing sides 206*a* and 206*b* of ink feed slot 206 and fluidically coupled to ink feed slot 206 to receive ink from ink feed slot 206. Drop generators 60 in data line groups D1-D6, indicated at 212*f*, 214*f*, 216*f*, 218*f*, 220*f* and 222*f* are disposed along one side 206*b* of ink feed slot 206. Drop generators 60 in data line groups D7 and D8, indicated at 224*f* and 226*f*, are disposed along the opposing side 206*a* of ink feed slot 206. The drop generators 60 in data line groups D1-D6 at 212*f*, 214*f*, 216*f*, 218*f*, 220*f* and 222*f* are disposed between one side 200*b* of printhead die 200 and ink feed slot 206. Drop generators 60 in data line groups D7 and D8 at 224*f* and 226*f* are disposed along an inside channel of printhead die 200 between ink feed slot 204 and ink feed slot 206.

In one embodiment, drop generators 60 in data line groups D1-D6 at 212*f*, 214*f*, 216*f*, 218*f*, 220*f* and 222*f* are located along the length of one side 206*b* of ink feed slot 206, such that data line group D1 at 212*f* is next to data line group D2 at 214*f*, which is between data line group D1 at 212*f* and data line group D3 at 216*f*. Data line group D4 at 218*f* is between data line group D3 at 216*f* and data line group D5 at 220*f*. Data line group D6 at 222*f* is next to data line group D5 at 220*f*. Drop generators 60 in data line groups D7 and D8 at 224*f* and 226*f* are located along the opposing side 206*a* of ink feed slot 206, such that data line group D5 at 220*f* is opposite data line group D7 at 224*f* and data line group D6 at 222*f* is opposite data line group D8 at 226*f*.

Fire group 2 (FG2) 202*b* is disposed along the first parts of ink feed slots 204 and 206. The drop generators 60 in FG2 at 202*b* are disposed along side 204*b* of ink feed slot 204 and side 206*a* of ink feed slot 206. Drop generators 60 in data line groups D1, D3, D5 and D7, indicated at 212*b*, 216*b*, 220*b* and 224*b* are disposed along side 204*b* of ink feed slot 204 and fluidically coupled to ink feed slot 204 to receive ink from ink feed slot 204. Drop generators 60 in data line groups D2, D4, D6 and D8, indicated at 214*b*, 218*b*, 222*b* and 226*b* are disposed along side 206*a* of ink feed slot 206 to receive ink from ink feed slot 206. The drop generators 60 in FG2 at 202*b* are disposed between ink feed slots 204 and 206.

In one embodiment, drop generators 60 in data line groups D1, D3, D5 and D7 at 212*b*, 216*b*, 220*b* and 224*b* are located along the length of side 204*b* of ink feed slot 204 and drop generators 60 in data line groups D2, D4, D6 and D8 at 214*b*, 218*b*, 222*b* and 226*b* are located along the length of side 206*a* of ink feed slot 206. Data line group D1 at 212*b* in FG2 at 202*b* on side 204*b* of ink feed slot 204 is across from or opposite data line group D3 at 216*a* in FG1 at 202*a* along side 204*a*. Data line group D3 at 216*b* in FG2 at 202*b* is opposite data line group D4 at 218*a* in FG1 at 202*a*. Data line group D5 at 220*b* in FG2 at 202*b* is opposite data line group D5 at 220*a* in FG1 at 202*a*. Data line group D7 at 224*b* in FG2 at 202*b* is opposite data line group D6 at 222*a* in FG1 at 202*a*.

Along ink feed slot 206, data line group D2 at 214*b* in FG2 at 202*b* is along side 206*a* of ink feed slot 206 and across from or opposite data line group D3 at 216*c* in FG3 at 202*c* along side 206*b*. Data line group D4 at 218*b* in FG2 at 202*b* is opposite data line group D4 at 218*c* in FG3 at 202*c*. Data line group D6 at 222*b* in FG2 at 202*b* is opposite data line group D5 at 220*c* in FG3 at 202*c*, and data line group D8 at 226*b* in FG2 at 202*b* is opposite data line group D6 at 222*c* in FG3 at 202*c*.

Fire group 5 (FG5) 202*e* is disposed along the second parts of ink feed slots 204 and 206. The drop generators 60 in FG5 at 202*e* are disposed along side 204*b* of ink feed slot 204 and side 206*a* of ink feed slot 206. Drop generators 60 in data line groups D1, D3, D5 and D7, indicated at 212*e*, 216*e*, 220*e* and 224*e* are disposed along side 204*b* of ink feed slot 204 and fluidically coupled to ink feed slot 204 to receive ink from ink feed slot 204. Drop generators 60 in data line groups D2, D4, D6 and D8, indicated at 214*e*, 218*e*, 222*e* and 226*e* are disposed along side 206*a* of ink feed slot 206 to receive ink from ink feed slot 206. The drop generators 60 in FG5 at 202*e* are disposed between ink feed slots 204 and 206.

In one embodiment, drop generators 60 in data line groups D1, D3, D5 and D7 at 212*e*, 216*e*, 220*e* and 224*e* are located along the length of side 204*b* of ink feed slot 204 and drop generators 60 in data line groups D2, D4, D6 and D8 at 214*e*, 218*e*, 222*e* and 226*e* are located along the length of side 206*a* of ink feed slot 206. Data line group D1 at 212*e* in FG5 at 202*e* on side 204*b* of ink feed slot 204 is across from or opposite data line group D1 at 212*d* in FG4 at 202*d* along side 204*a*. Data line group D3 at 216*e* in FG5 at 202*e* is opposite data line group D2 at 214*d* in FG4 at 202*d*. Data line group D5 at 220*e* in FG5 at 202*e* is opposite data line group D3 at 216*d* in FG4 at 202*d*. Data line group D7 at 224*e* in FG5 at 202*e* is opposite data line group D4 at 218*d* in FG4 at 202*d*.

Along ink feed slot 206, data line group D2 at 214*e* in FG5 at 202*e* is along side 206*a* of ink feed slot 206 and across from or opposite data line group D1 at 212*f* in FG6 at 202*f* along side 206*b*. Data line group D4 at 218*e* in FG5 at 202*e* is opposite data line group D2 at 214*f* in FG6 at 202*f*. Data line group D6 at 222*e* in FG5 at 202*e* is opposite data line group D3 at 216*f* in FG6 at 202*f*, and data line group D8 at 226*e* in FG5 at 202*e* is opposite data line group D4 at 218*f* in FG6 at 202*f*.

In one embodiment, printhead die 200 includes 672 drop generators 60. Each of the six fire groups 202*a*-202*f* includes 112 drop generators 60. Each part of a data line group D1-D8 at 212, 214, 216, 218, 220, 222, 224 and 226 in a fire group 202*a*-202*f* includes 14 drop generators 60, such that each fire group 202*a*-202*f* includes 14 row subgroups coupled to 8 data lines 108*a*-108*h*. In other embodiments, printhead die 200 can include any suitable number of drop generators 60, such as 600 drop generators 60, arranged in any suitable pattern of drop generators per fire group and drop generators per data line group or part of a data line group. In addition, printhead die 200 can include any suitable number of fire groups and any suitable number of data line groups.

The conductive fire lines 208*a*-208*f* are electrically coupled to firing resistors 52 in drop generators 60 in fire groups 202*a*-202*f*. Fire line 208*a* is electrically coupled to each firing resistor 52 in FG1 at 202*a*. Fire line 208*a* is disposed between one side 200*a* of printhead die 200 and ink feed slot 204 and between ink feed slots 204 and 206. Fire line 208*a* is coupled at one end 204*c* of ink feed slot 204 to form a substantially J-shaped or substantially U-shaped fire line. The portion of fire line 208*a* disposed between side 200*a* and ink feed slot 204 is electrically coupled to firing resistors 52 in data line groups D1-D6 at 212*a*, 214*a*, 216*a*, 218*a*, 220*a* and 222*a*. The portion of fire line 208*a* disposed between ink feed slot 204 and ink feed slot 206 is electrically coupled to firing resistors 52 in data line groups D7 and D8 at 224*a* and 226*a*. Fire line 208*a* receives and supplies energy signal FIRE 1 including energy pulses to firing resistors 52 in FG1 at 202*a*.

Fire line 208*d* is electrically coupled to each firing resistor 52 in FG4 at 202*d*. Fire line 208*d* is disposed between one side 200*a* of printhead die 200 and ink feed slot 204 and between ink feed slots 204 and 206. Fire line 208*d* is coupled at one end 204*d* of ink feed slot 204 to form a substantially J-shaped or partial substantially U-shaped fire line. The portion of fire line 208*d* disposed between side 200*a* and ink feed slot 204 is electrically coupled to firing resistors 52 in data line groups D1-D6 at 212*d*, 214*d*, 216*d*, 218*d*, 220*d* and 222*d*. The portion of fire line 208*d* disposed between ink feed slot 204 and ink feed slot 206 is electrically coupled to firing resistors 52 in data line groups D7 and D8 at 224*d* and 226*d*. Fire line 208*d* receives and supplies energy signal FIRE4 including energy pulses to firing resistors 52 in FG4 at 202*d*.

Fire line 208*c* is electrically coupled to each firing resistor 52 in FG3 at 202*c*. Fire line 208*c* is disposed between one side 200*b* of printhead die 200 and ink feed slot 206 and between ink feed slots 204 and 206. Fire line 208*c* is coupled at one end 206*c* of ink feed slot 206 to form a substantially J-shaped or partial substantially u-shaped fire line. The portion of fire line 208*c* disposed between side 200*b* and ink feed slot 206 is electrically coupled to firing resistors 52 in data line groups D1-D6 at 212*c*, 214*c*, 216*c*, 218*c*, 220*c* and 222*c*. The portion of fire line 208*c* disposed between ink feed slot 204 and ink feed slot 206 is electrically coupled to firing resistors 52 in data line groups D7 and D8 at 224*c* and 226*c*. Fire line 208*c* receives and supplies energy signal FIRE 3 including energy pulses to firing resistors 52 in FG3 at 202*c*.

Fire line 208*f* is electrically coupled to each firing resistor 52 in FG6 at 202*f*. Fire line 208*f* is disposed between one side 200*b* of printhead die 200 and ink feed slot 206 and between ink feed slots 204 and 206. Fire line 208*f* is coupled at one end 206*d* of ink feed slot 206 to form a substantially J-shaped or partial substantially U-shaped fire line. The portion of fire line 208*f* disposed between side 200*b* and ink feed slot 206 is electrically coupled to firing resistors 52 in data line groups D1-D6 at 212*f*, 214*f*, 216*f*, 218*f*, 220*f* and 222*f*. The portion of fire line 208*f* disposed between ink feed slot 204 and ink feed slot 206 is electrically coupled to firing resistors 52 in data line groups D7 and D8 at 224*f* and 226*f*. Fire line 208*f* receives and supplies energy signal FIRE6 including energy pulses to firing resistors 52 in FG6 at 202*f*.

Fire line 208*b* is electrically coupled to each firing resistor 52 in FG2 at 202*b*. Fire line 208*b* is disposed between ink feed slots 204 and 206. One section 230 of fire line 208*b* is located across firing cells 70 in data line groups D1, D3, D5 and D7 at 212*b*, 216*b*, 220*b* and 224*b* next to ink feed slot 204 and another section 232 of fire line 208*b* is located across firing cells 70 in data line groups D2, D4, D6 and D8 at 214*b*, 218*b*, 222*b* and 226*b* next to ink feed slot 206. The sections 230 and 232 are electrically coupled together at 234 between ink feed slots 204 and 206 and a third section or post section 236 of fire line 208*b* is electrically coupled to the first and second sections 230 and 232 and extends toward side 200*c* of printhead die 200. Fire line 208*b* receives and supplies energy signal FIRE 2 including energy pulses to firing resistors 52 in FG2 at 202*b*.

Fire line 208*e* is electrically coupled to each firing resistor 52 in FG5 at 202*e*. Fire line 208*e* is disposed between ink feed slots 204 and 206. One section 240 of fire line 208*e* is located across firing cells 70 in data line groups D1, D3, D5 and D7 at 212*e*, 216*e*, 220*e* and 224*e* next to ink feed slot 204 and another section 242 of fire line 208*e* is located across firing cells 70 in data line groups D2, D4, D6 and D8 at 214*e*, 218*e*, 222*e* and 226*e* next to ink feed slot 206. The sections 240 and 242 are electrically coupled together at 244 between ink feed slots 204 and 206 and a third section or post section 246 of fire line 208*e* is electrically coupled to first and second sections 240 and 242 and extends toward side 200*d* of printhead die 200. Fire line 208*e* receives and supplies energy signal FIRE5 including energy pulses to firing resistors 52 in FG5 at 202*e*.

Enable lines 210 are electrically coupled to firing cells 70 in row subgroups in fire groups 202*a*-202*f*. The enable lines 210 are electrically coupled to firing cells 70 in row subgroups as previously described for enable lines 106*a*-106L. Enable lines 210 receive subgroup enable signals SG1, SG2, . . . $SG_L$ and provide the received signals to firing cells 70 in row subgroups. The subgroup enable signals SG1, SG2, . . . $SG_L$ enable one row subgroup of firing cells 70 to receive and store data signals D1-D8 provided on data lines 108*a*-108*h*.

The enable lines 210 are located between ink feed slot 204 and printhead die side 200*a* and between ink feed slot 206 and printhead die side 200*b*. In addition, enable lines 210 are routed between ink feed slots 204 and 206. The enable lines 210 extend along one side 200*c* of printhead die 200. In one embodiment, some of the enable lines 210 are divided into two groups of enable lines. One group provides enable signals to fire groups 202*a*-202*c* and another group provides enable signals to fire groups 202*d*-202*f*.

Figure 7:
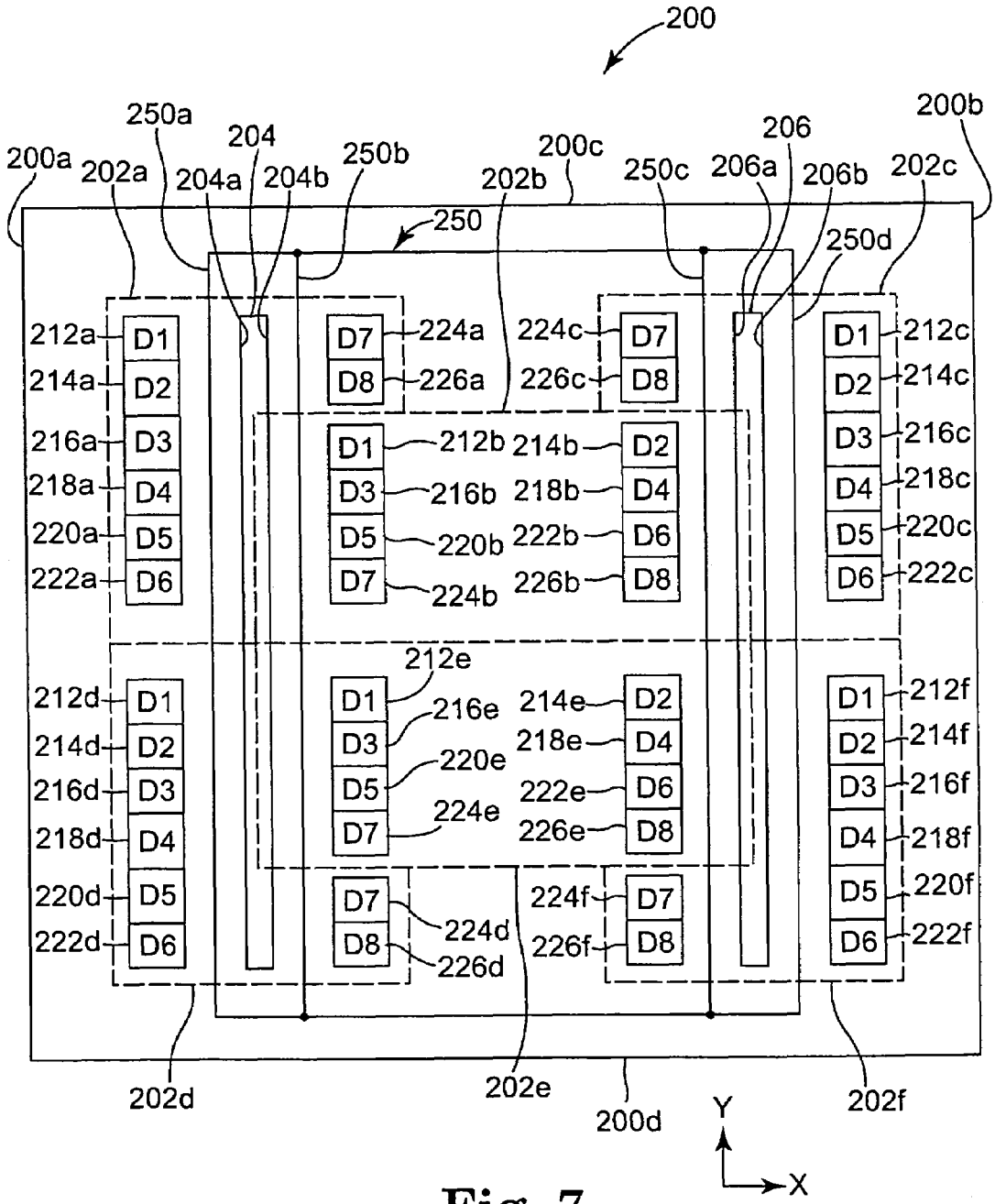
FIG. 7 is a block diagram illustrating one embodiment of a layout of a reference conductor in a printhead die.

FIG. 7 is a block diagram illustrating one embodiment of a layout of a reference conductor 250 in printhead die 200. The printhead die 200 includes the six fire groups 202*a*-202*f*, two ink feed slots 204 and 206 and reference conductor 250. The reference conductor 250 is electrically coupled to each of the firing cells 70 in each of the fire groups 202*a*-202*f*. The drain-source path of each drive switch 72 in each of the firing cells 70 is electrically coupled to reference conductor 250. In addition, reference conductor 250 is electrically coupled to a reference voltage, such as ground. In one embodiment, reference conductor 250 is coupled through external contacts to external circuitry or ground paths. (See, FIG. 15).

The fire groups 202*a*-202*f* are disposed along ink feed slots 204 and 206. Fire groups 202*a* and 202*d* are located along ink feed slot 204, and fire groups 202*c* and 202*f* are located along ink feed slot 206. Fire groups 202*b* and 202*e* are located along both ink feed slots 204 and 206.

The fire groups 202*a*-202*f* are divided into eight data line groups D1-D8, indicated at 212, 214, 216, 218, 220, 222, 224 and 226. Each data line group D1-D8 at 212, 214, 216, 218, 220, 222, 224 and 226 includes firing cells 70 from each fire group 202*a*-202*f*. Each firing cell 70 in a data line group D1-D8 at 212, 214, 216, 218, 220, 222, 224 and 226 is electrically coupled to the corresponding one of eight data lines 108*a*-108*h*. The fire groups 202*a*-202*f* and data line groups D1-D8 at 212, 214, 216, 218, 220, 222, 224 and 226 are disposed along ink feed slots 204 and 206 as previously described in detail herein.

The ink feed slots 204 and 206 are spaced apart and parallel to one another. Each ink feed slot 204 and 206 includes a length that extends along the y-direction of printhead die 200. Ink feed slot 204 includes opposing sides 204*a* and 204*b* along the length of ink feed slot 204, and ink feed slot 206 includes opposing sides 206*a* and 206*b* along the length of ink feed slot 206. The ink feed slots 204 and 206 supply ink to drop generators 60 in fire groups 202*a*-202*f*.

The reference conductor 250 includes a first portion 250*a*, a second portion 250*b*, a third portion 250*c* and a fourth portion 250*d* electrically coupled together at each end of ink feed slots 204 and 206. The reference conductor 250 is disposed along each of the opposing sides 204*a* and 204*b* of ink feed slot 204, and along each of the opposing sides 206*a* and 206*b* of ink feed slot 206. The portions 250*a*-250*d* are electrically coupled together along side 200*c* of printhead die 200 and along side 200*d* of printhead die 200.

The first portion 250*a* of reference conductor 250 is situated across each firing cell 70 in data line groups D1-D6 at 212*a*, 214*a*, 216*a*, 218*a*, 220*a* and 222*a* in FG1 at 202*a*. The first portion 250*a* of reference conductor 250 is also situated across each firing cell 70 in data line groups D1-D6 at 212*d*, 214*d*, 216*d*, 218*d*, 220*d* and 222*d* in FG4 at 202*d*. The first portion 250*a* is positioned along side 204*a* of ink feed slot 204 and between ink feed slot 204 and side 200*a* of printhead die 200.

The second portion 250*b* of reference conductor 250 is situated across each firing cell 70 in data line groups D7 and D8 at 224*a* and 226*a* in FG1 at 202*a*, data line groups D1, D3, D5 and D7 at 212*b*, 216*b*, 220*b* and 224*b* in FG2 at 202*b*, data line groups D1, D3, D5 and D7 at 212*e*, 216*e*, 220*e* and 224*e* in FG5 at 202*e* and data line groups D7 and D8 at 224*d* and 226*d* in FG4 at 202*d*. The second portion 250*b* is situated along side 204*b* of ink feed slot 204 and between ink feed slots 204 and 206.

The third portion 250*c* of reference conductor 250 is situated across each firing cell 70 in data line groups D7 and D8 at 224*c* and 226*c* in FG3 at 202*c*, data line groups D2, D4, D6 and D8 at 214*b*, 218*b*, 222*b* and 226*b* in FG2 at 202*b*, data line groups D2, D4, D6, D8 at 214*e*, 218*e*, 222*e* and 226*e* in FG5 at 202*e* and data line groups D7 and D8 at 224*f* and 226*f* in FG6 at 202*f*. The third portion 250*c* is situated along side 206*a* of ink feed slot 206 and between ink feed slots 204 and 206.

The fourth portion 250*d* of reference conductor 250 is situated across each firing cell 70 in data line groups D1-D6 at 212*c*, 214*c*, 216*c*, 218*c*, 220*c* and 222*c* in FG3 at 202*c* and data line groups D1-D6 at 212*f*, 214*f*, 216*f*, 218*f*, 220*f* and 222*f* in FG6 at 202*f*. The fourth portion 250 is situated along side 206*b* of ink feed slot 206 and between ink feed slot 206 and side 200*b* of printhead die 200. The portions 250*a*-250*d* of reference conductor 250 are electrically coupled together along sides 200*c* and 200*d* of printhead die 200.

Figure 8:
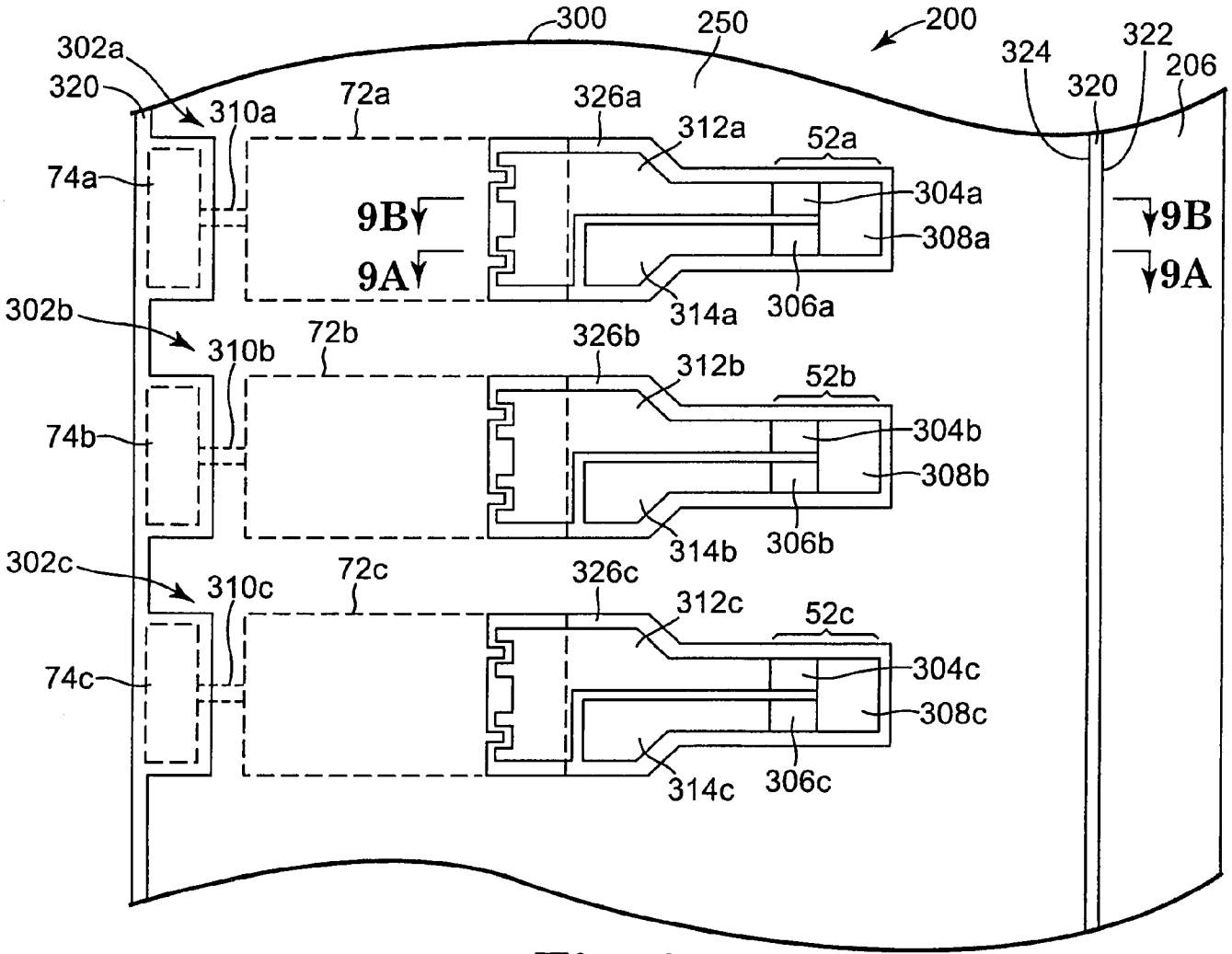
FIG. 8 is a plan view diagram illustrating one embodiment of a section at a first metal layer of a printhead die.

FIG. 8 is a plan view diagram illustrating one embodiment of a section 300 taken at the first metal layer of printhead die 200, depicting overlapping and non-overlapping regions from multiple layers. The actual structures described may be formed in one or more layers.

The section 300 includes three firing cells, indicated at 302*a*-302*c*, ink feed slot 206 and reference conductor 250. The three firing cells 302*a*-302*c* are similar to firing cells 70 throughout printhead die 200 and instances of firing cells 70 that are part of data line group D7 at 224*c* in FG3 at 202*c*. The firing cells 302*a*-302*c* include memory circuits 74*a*-74*c*, drive switches 72*a*-72*c* and firing resistors, indicated at 52*a*-52*c*.

The firing cell 302*a* includes memory circuit 74*a*, drive switch 72*a* and firing resistor 52*a*. The firing resistor 52*a* includes a first resistive segment 304*a*, a second resistive segment 306*a* and a conductive shorting bar 308*a*. The first resistive segment 304*a* and second resistive segment 306*a* are separate resistive segments electrically coupled together through conductive shorting bar 308*a*. The memory circuit 74*a* is electrically coupled to the gate of drive switch 72*a* through a substrate lead 310*a*. One side of the drain-source path of drive switch 72*a* is electrically coupled to reference conductor 250. The reference conductor 250 contacts drive switch 72*a* where the reference conductor 250 is disposed over, e.g. in a layer above, at least a portion of drive switch 72*a*. The other side of the drain-source path of drive switch 72*a* is electrically coupled to a drive switch conductive lead 312*a* that electrically couples the drain-source path of drive switch 72*a* to first resistive segment 304*a*. The second resistive segment 306*a* is electrically coupled to fire line 208*c* through fire line conductive lead 314*a*.

The firing cell 302*b* includes memory circuit 74*b*, drive switch 72*b* and firing resistor 52*b*. The firing resistor 52*b* includes a first resistive segment 304*b*, a second resistive segment 306*b* and a conductive shorting bar 308*b*. The first resistive segment 304*b* and second resistive segment 306*b* are separate resistive segments electrically coupled together through shorting bar 308*b*. The memory circuit 74*b* is electrically coupled to the gate of drive switch 72*b* through a substrate lead 310*b*. One side of the drain-source path of drive switch 72*b* is electrically coupled to reference conductor 250. The reference conductor 250 contacts drive switch 72*b* where the reference conductor 250 is disposed over a portion of drive switch 72*b*. The other side of the drain-source path of drive switch 72*b* is electrically coupled to a drive switch conductive lead 312*b* that electrically couples the drain-source path of drive switch 72*b* to first resistive segment 304*b*. The second resistive segment 306*b* is electrically coupled to fire line 208*c* through fire line conductive lead 314*b*.

The firing cell 302*c* includes memory circuit 74*c*, drive switch 72*c* and firing resistor 52*c*. The firing resistor 52*c* includes a first resistive segment 304*c*, a second resistive segment 306*c* and a conductive shorting bar 308*c*. The first resistive segment 304*c* and second resistive segment 306*c* are separate resistive segments electrically coupled together through shorting bar 308*c*. The memory circuit 74*c* is electrically coupled to the gate of drive switch 72*c* through a substrate lead 310*c*. The drain-source path of drive switch 72*c* is electrically coupled to reference conductor 250. The reference conductor 250 contacts the drive switch 72*c* where the reference conductor 250 is disposed over a portion of drive switch 72*c*. The other side of the drain-source path of drive switch 72*c* is electrically coupled to a drive switch conductive lead 312*c* that electrically couples the drain-source path of drive switch 72*c* to first resistive segment 304*c*. The second resistive segment 306*c* is electrically coupled to fire line 208*c* through fire line conductive lead 314*c*.

The firing cells 302*a*-302*c* are formed in and on semiconductor substrate 320 of printhead die 200. The memory circuits 74*a*-74*c*, drive switches 72*a*-72*c* and substrate leads 310*a*-310*c* are formed in substrate 320 of printhead die 200. The reference conductor 250, drive switch conductive leads 312*a*-312*c*, fire line conductive leads 314*a*-314*c* and shorting bars 308*a*-308*c* are formed as part of the first metal layer that is formed on substrate 320. In addition, first resistive segments 304*a*-304*c* and second resistive segments 306*a*-306*c* are formed as part of a resistive layer. In other embodiments, portions of reference conductor 250 may be formed in both first metal layer and second metal layer (not shown).

The ink feed slot 206 is formed in substrate 320 and provides ink to firing resistors 52*a*-52*c*. The ink feed slot 206 includes an ink feed slot edge 322 at the surface of substrate 320. The ink feed slot edge 322 is in communication with the surface of substrate 320 along the length of ink feed slot 206. The reference conductor 250, at 324 is disposed along ink feed slot 206 and spaced apart from ink feed slot edge 322. Opposing side 206*a* of ink feed slot 206 includes ink feed slot edge 322 and opposing side 206*b* of ink feed slot 206 includes an ink feed slot edge similar to ink feed slot edge 322. In addition, each of the opposing sides 204*a* and 204*b* of ink feed slot 204 includes an ink feed slot edge in communication with the surface of substrate 320 and similar to ink feed slot edge 322.

Portions of reference conductor 250 are formed in first metal layer, other portions may or may not be formed in second metal layer, and disposed between memory circuits 74*a*-74*c* and ink feed slot 206. The drive switch conductive leads 312*a*-312*c*, fire line conductive leads 314*a*-314*c* and firing resistors 52*a*-52*c* are isolated from reference conductor 250 and disposed in firing resistor areas 326*a*-326*c*. Firing resistor area 326*a* includes drive switch conductive lead 312*a*, fire line conductive lead 314*a* and firing resistor 52*a*. Firing resistor area 326*b* includes drive switch conductive lead 312*b*, fire line conductive lead 314*b* and firing resistor 52*b*. Firing resistor area 326*c* includes drive switch conductive lead 312*c*, fire line conductive lead 314*c* and firing resistor 52*c*.

The reference conductor 250 is disposed over a portion of each of the drive switches 72*a*-72*c* between memory circuits 74*a*-74*c* and firing resistor areas 326*a*-326*c*, including drive switch conductive leads 312*a*-312*c*. The reference conductor 250 is also disposed between ink feed slot edge 322 and firing resistor areas 326*a*-326*c*, including firing resistors 52*a*-52*c*. In addition, the reference conductor 250 is disposed between firing resistor areas 326*a*-326*c* of adjacent firing cells 302*a*-302*c*. The reference conductor 250 is substantially planar between memory circuits 74*a*-74*c* and ink feed slot edge 322. The reference conductor 250 has a larger or increased area due to the portion of reference conductor 250 that is disposed between ink feed slot edge 322 and firing resistor areas 326*a*-326*c*. The larger area reference conductor 250 reduces the energy variation between firing cells 70 and provides a more uniform ink pattern.

In the above described embodiment, the reference conductor 250 is disposed between ink feed slot edge 322 and firing resistor areas 326*a*-326*c* and is also disposed between and substantially planar with firing resistors areas 326*a*-326*c* of adjacent firing cells 302*a*-302*c*. In this embodiment, the reference conductor 250 is substantially planar with firing resistors 52*a*-52*c* but not the ink feed slot edge. In one embodiment, the ink feed slot edge is also planar with reference conductor 250. In one embodiment, the firing resistors 52*a*-52*c* are not substantially planar with reference conductor 250. Nevertheless, in all of these embodiments, the reference conductor is disposed between the ink feed slot edge and the firing resistors and is also disposed between the firing resistor areas of adjacent firing cells regardless of planar relationships.

In operation, one of the firing cells 302*a*-302*c* is fired or energized at a time. In one example operation, memory circuit 74*a* provides a voltage level on the gate of drive switch 72*a* to turn drive switch 72*a* on or off. Fire line 208*c* receives energy signal FIRE 3 and provides an energy pulse to second resistive segment 306*a* through fire line conductive lead 314*a*.

If drive switch 72*a* is conducting, the energy pulse provides a current through firing resistor 52*a*, drive switch conductive lead 312*a* and drive switch 72*a* to reference conductor 250. With reference conductor 250 electrically coupled to a reference voltage, such as ground, the current flows through reference conductor 250 to ground.

As the current flows through reference conductor 250, the current flows between memory circuits 74*a*-74*c* and firing resistor areas 326*a*-326*c*, including drive switch conductive leads 312*a*-312*c*. The current also flows between adjacent firing resistor areas 326*a*-326*c* and between ink feed slot edge 322 and firing resistor areas 326*a*-326*c*, including firing resistors 52*a*-52*c*.

The layout of firing cells 302*a*-302*c* in section 300 is similar to the layout of firing cells 70 along ink feed slots 204 and 206 throughout printhead die 200. In addition, the layout of reference conductor 250 in section 300 is similar to the layout of reference conductor 250 along opposing sides 204*a* and 204*b* of ink feed slot 204 and along opposing sides 206*a* and 206*b* of ink feed slot 206 throughout printhead die 200.

Figure 9A:
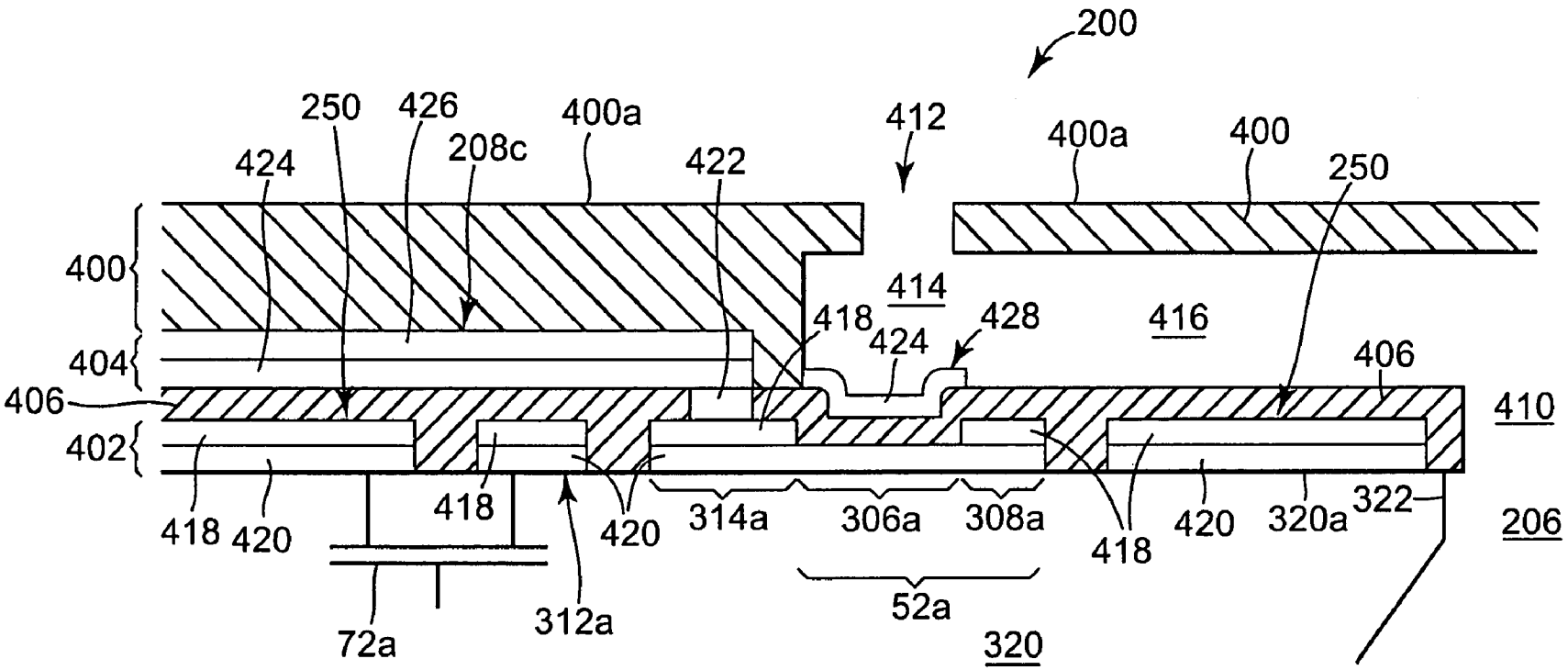
FIG. 9A is a diagram illustrating a partial cross-section of one embodiment of a printhead die taken at the position of line 9A in FIG. 8.
Figure 9B:
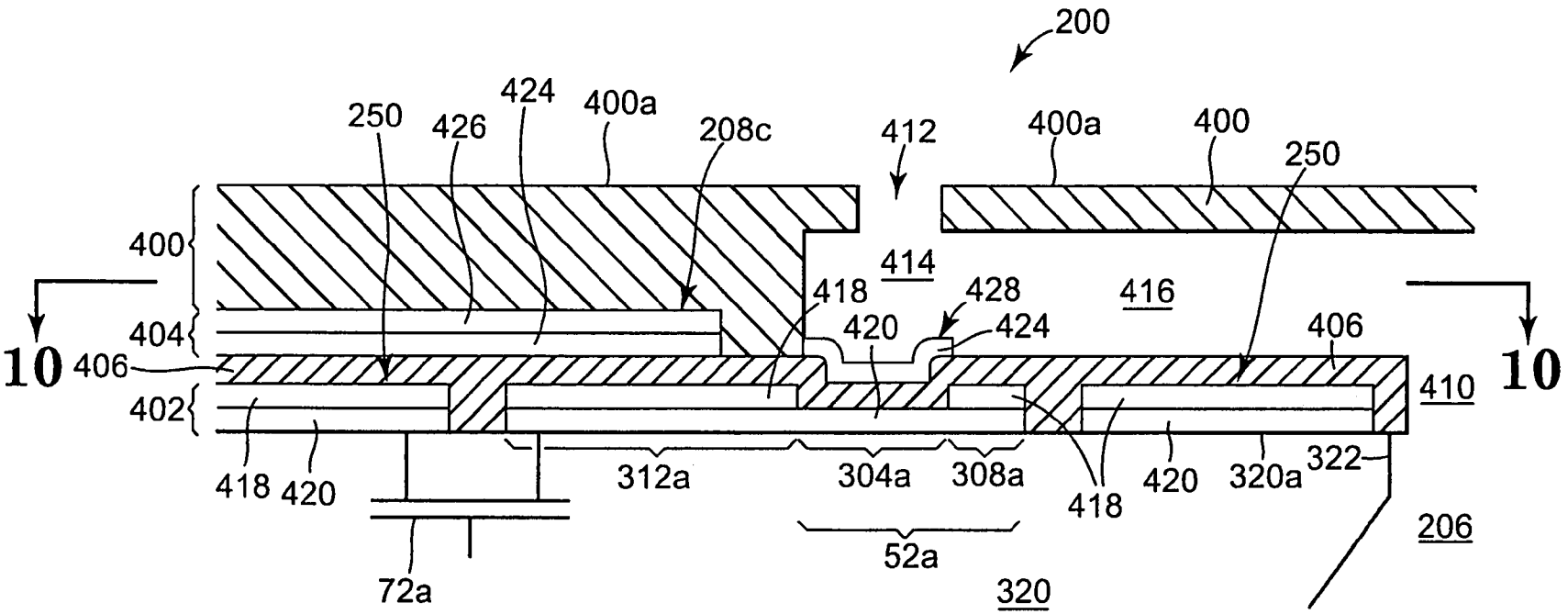
FIG. 9B is a diagram illustrating a partial cross-section of one embodiment of a printhead die taken at the position of line 9B in FIG. 8.

FIGS. 9A and 9B are diagrams illustrating partial cross-sections of one embodiment of printhead die 200 taken at the positions of lines 9A and 9B, respectively, in FIG. 8. FIGS. 9A and 9B are not drawn to scale for clarity.

Referring to FIGS. 9A and 9B, printhead die 200 includes an orifice layer 400, a first metal layer 402, a second metal layer 404, an isolation layer 406 and substrate 320. Drive switch 72*a* and ink feed slot 206 are formed in substrate 320 that includes a substrate surface 320*a*. The ink feed slot 206 includes ink feed slot edge 322 in communication with substrate surface 320*a*. The first metal layer 402 is formed on substrate surface 320*a*. Isolation layer 406 is formed on first metal layer 402 and substrate surface 320*a*.

The orifice layer 400 has a front face 400*a* and a nozzle opening 412 in the front face 400*a*. Orifice layer 400 also has a nozzle chamber or vaporization chamber 414 and a fluid path or ink feed path 416 formed therein. The firing resistor, indicated at 52*a*, is located at least partially under vaporization chamber 414, which is between firing resistor 52*a* and nozzle opening 412. The ink feed path 416 is located between vaporization chamber 414 and ink feed channel 410. The vaporization chamber 414 communicates with nozzle opening 412 and ink feed path 416. The ink feed path 416 communicates with vaporization chamber 414 and ink feed channel 410 that communicates with ink feed slot 206. The ink feed slot 206 supplies ink to vaporization chamber 414 through ink feed channel 410 and ink feed path 416.

The first metal layer 402 is formed on substrate 320 and insulated from second metal layer 404 by isolation layer 406. The first metal layer 402 includes a conductive layer 418 and a resistive layer 420. The conductive layer 418 is made of a suitable conductive material, for example aluminum-copper, and the resistive layer 420 is made of a suitable resistive material, for example tantalum-aluminum. The first metal layer 402 includes multiple leads and components in printhead die 200, including reference conductor 250, drive switch conductive lead 312*a*, fire line conductive lead 314*a* and firing resistor 52*a*.

The firing resistor 52*a* is made from first metal layer 402 and includes second resistive segment 306*a* and shorting bar 308*a*. The second resistive segment 306*a* includes resistive layer 420. Conductive layer 418 is not disposed on second resistive segment 306*a*. The shorting bar 308*a* includes conductive layer 418 and resistive layer 420. The second resistive segment 306*a* is electrically coupled to shorting bar 308*a* and fire line conductive lead 314*a*.

The fire line conductive lead 314*a* is made from first metal layer 402 and includes conductive layer 418 and resistive layer 420. The fire line conductive lead 314*a* is electrically coupled to second metal layer 404 through via 422 formed in isolation layer 406. The via 422 in isolation layer 406 is filled with material to electrically couple fire line conductive lead 314*a* to second metal layer 404.

The reference conductor 250 is disposed on substrate 320 over a portion of drive switch 72*a* and between firing resistor 52*a* and ink feed slot edge 322. The reference conductor 250 is electrically coupled to one side of the drain-source path of drive switch 72*a*. The other side of the drain-source path of drive switch 72*a* is electrically coupled to drive switch conductive lead 312*a* that is electrically coupled to first resistive segment 304*a* (shown in FIG. 9B) of firing resistor 52*a*. The reference conductor 250 and drive switch conductive lead 312*a* are formed as part of first metal layer 402 and include conductive layer 418 and resistive layer 420.

In one embodiment, isolation layer 406 comprises an insulating passivation layer disposed over first metal layer 402, including reference conductor 250 and firing resistor 52*a*. The isolation layer 406 is disposed along ink feed slot edge 322. The isolation layer 406 covers reference conductor 250 between firing resistor 52*a* and ink feed slot edge 322 and prevents ink from touching and corroding reference conductor 250.

In one embodiment, isolation layer 406 is disposed over shorting bar 308*a* and second resistive segment 306*a* and prevents ink from touching and corroding shorting bar 308*a* and second resistive segment 306*a*. In one embodiment, isolation layer 406 is disposed over fire line conductive lead 314*a*, drive switch conductive lead 312*a* and the portion of reference conductor 250 disposed over drive switch 72*a*. Via 422 is etched in isolation layer 406 to electrically couple fire line conductive lead 314*a* (first metal layer 402) and second metal layer 404. The isolation layer 406 is formed as part of a suitable insulating material. In one embodiment, isolation layer 406 includes two layers, for example a silicon-carbide layer and a silicon-nitride layer.

The second metal layer 404 includes fire line 208*c* that is electrically coupled through via 422 to fire line conductive lead 314*a*. The second metal layer 404 includes a first layer 424, made from a suitable material, for example tantalum, and a second layer 426 made from a suitable conductive material, for example gold. The first layer 424 is disposed to make contact with fire line conductive lead 314*a* through via 422. In addition, the first layer 424 is disposed at 428 on isolation layer 406 over second resistive segment 306*a*. The first layer 424 at 428 protects isolation layer 406 as ink is heated by firing resistor 52*a*. The second layer 426 is a conductive gold layer disposed on first layer 424 to form fire line 208*c*. The fire line 208*c* receives energy signal FIRE 3 and provides energy pulses to second resistive segment 306*a* and firing resistor 52*a* to heat and eject ink from vaporization chamber 414 through nozzle 412.

Referring to FIG. 9B, firing resistor 52*a* is made from first metal layer 402 and includes first resistive segment 304*a* and shorting bar 308*a*. The first resistive segment 304*a* includes resistive layer 420. Conductive layer 418 is not disposed on first resistive segment 304*a*. The first resistive segment 304*a* is electrically coupled to shorting bar 308*a* and drive switch conductive lead 312*a*.

In one embodiment, isolation layer 406 is disposed over shorting bar 308*a* and first resistive segment 304*a*. In one embodiment, isolation layer 406 is disposed overdrive switch conductive lead 312*a* and a portion of reference conductor 250 disposed over drive switch 72*a*.

The first layer 424 of second metal layer 404 is disposed at 428 on isolation layer 406 over first resistive segment 304*a*. The first layer 424 at 428 protects the isolation layer 406 as ink is heated by firing resistor 52*a*.

In operation, memory circuit 74*a* is enabled and receives data to turn drive switch 72*a* on or off. The memory circuit 74*a* provides a voltage on the gate of drive switch 72*a* to either turn drive switch 72*a* on (conducting) or off (non-conducting). An energy pulse is received on fire line 208*c* and provided to second resistive segment 306*a*. If drive switch 72*a* is conducting, the energy pulse creates an energy current that flows through fire line 208*c* and fire line conductive lead 314*a* to second resistive segment 306*a*. The current flows through the second resistive segment 306*a* and shorting bar 308*a* to first resistive segment 304*a* and drive switch conductive lead 312*a*. The current flows through the conducting drain-source path of drive switch 72*a* to reference conductor 250 and out of printhead die 200. As the current flows through reference conductor 250, the current flows between firing resistor areas 326*a*-326*c* and to the portion of reference conductor 250 between firing resistors 52*a* and ink feed slot edge 322.

In the embodiment depicted in FIGS. 9A and 9B, conductive layer 418 has a height that is in a range of 0.3-1.5 um, which in an exemplary embodiment is 0.5 um, and resistive layer 420 is in a range of 0.3-1.5 um, which in an exemplary embodiment is 0.5 um. In this embodiment, first layer 424 has a height that is in a range of 0.3-1.5 um, which in an exemplary embodiment is 0.36 um, and second layer 426 that has a height similar to that of resistive layer 420.

An embodiment of the location of fire lines, and ground lines, address lines in metal layer 1 and metal layer 2 is depicted and disclosed in co-pending patent application Ser. No. 10/787,573 which is incorporated by reference in its entirety.

Figure 10:
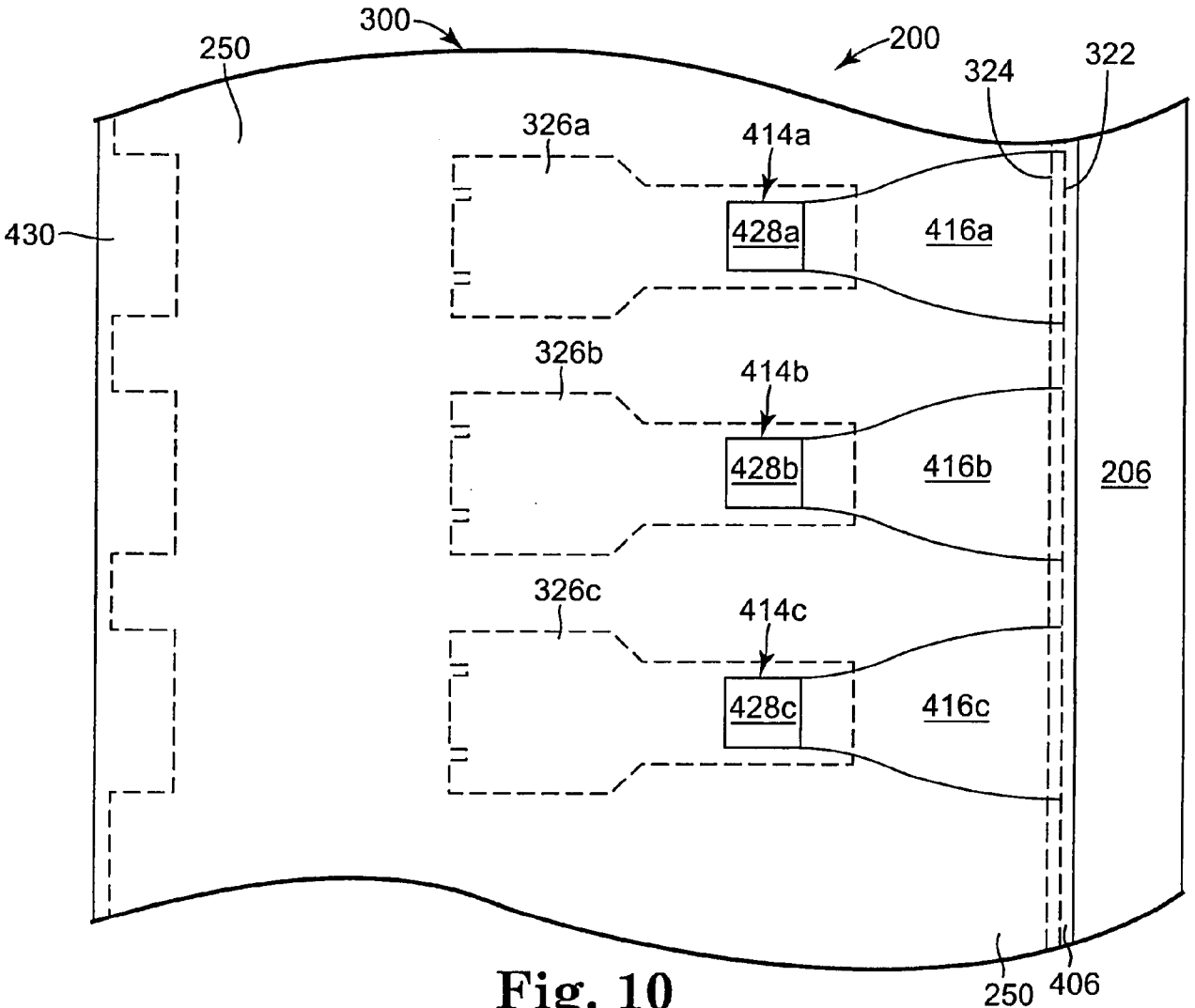
FIG. 10 is a diagram illustrating one embodiment of a section of a printhead die at the position of line 10 in FIG. 9B.

FIG. 10 is a diagram illustrating one embodiment of section 300 of printhead die 200 at the position of line 10 in FIG. 9B. The printhead die 200 includes ink feed slot 206, fluid paths or ink feed paths 416*a*-416*c* and vaporization chambers, indicated at 414*a*-414*c*. The ink feed paths 416*a*-416*c* and vaporization chambers 414*a*-414*c* correspond to firing cells 302*a*-302*c*. Ink feed path 416*a* and vaporization chamber 414*a* correspond to firing cell 302*a*. Ink feed path 416*b* and vaporization chamber 414*b* correspond to firing cell 302*b*, and ink feed path 416*c* and vaporization chamber 414*c* correspond to firing cell 302*c*.

The vaporization chambers 414*a*-414*c* include first layer 424 at 428*a*-428*c* over first resistive segments 304*a*-304*c* and second resistive segments 306*a*-306*c*. Vaporization chamber 414*a* includes first layer 424 at 428*a* over first resistive segment 304*a* and second resistive segment 306*a*. Vaporization chamber 414*b* includes first layer 424 at 428*b* over first resistive segment 304*b* and second resistive segment 306*b*. Vaporization chamber 414*c* includes first layer 424 at 428*c* over first resistive segment 304*c* and second resistive segment 306*c*.

The reference conductor 250 is situated on each side of firing resistor areas 326*a*-326*c*. The reference conductor 250 is situated between firing resistor areas 326*a*-326*c* and a memory circuit and routing channel area, indicated at 430. The reference conductor 250 is also situated between adjacent firing resistor areas 326*a*-326*c*. In addition, reference conductor 250 is disposed under ink feed paths 416*a*-416*c* and between firing resistor areas 326*a*-326*c* and ink feed slot edge 322. The reference conductor 250 at 324 is located next to ink feed slot edge 322 along the length of ink feed slot 206.

Ink feed slot 206 is fluidically coupled to ink feed paths 416*a*-416*c*, which are fluidically coupled to vaporization chambers 414*a*-414*c*, respectively. The reference conductor 250 is isolated by isolation layer 406 from ink flowing from ink feed slot 206 through ink feed paths 416*a*-416*c*. Ink from ink feed slot 206 flows through ink feed paths 416*a*-416*c* to vaporization chambers 414*a*-414*c* over isolation layer 406 that covers reference conductor 250.

Figure 11:
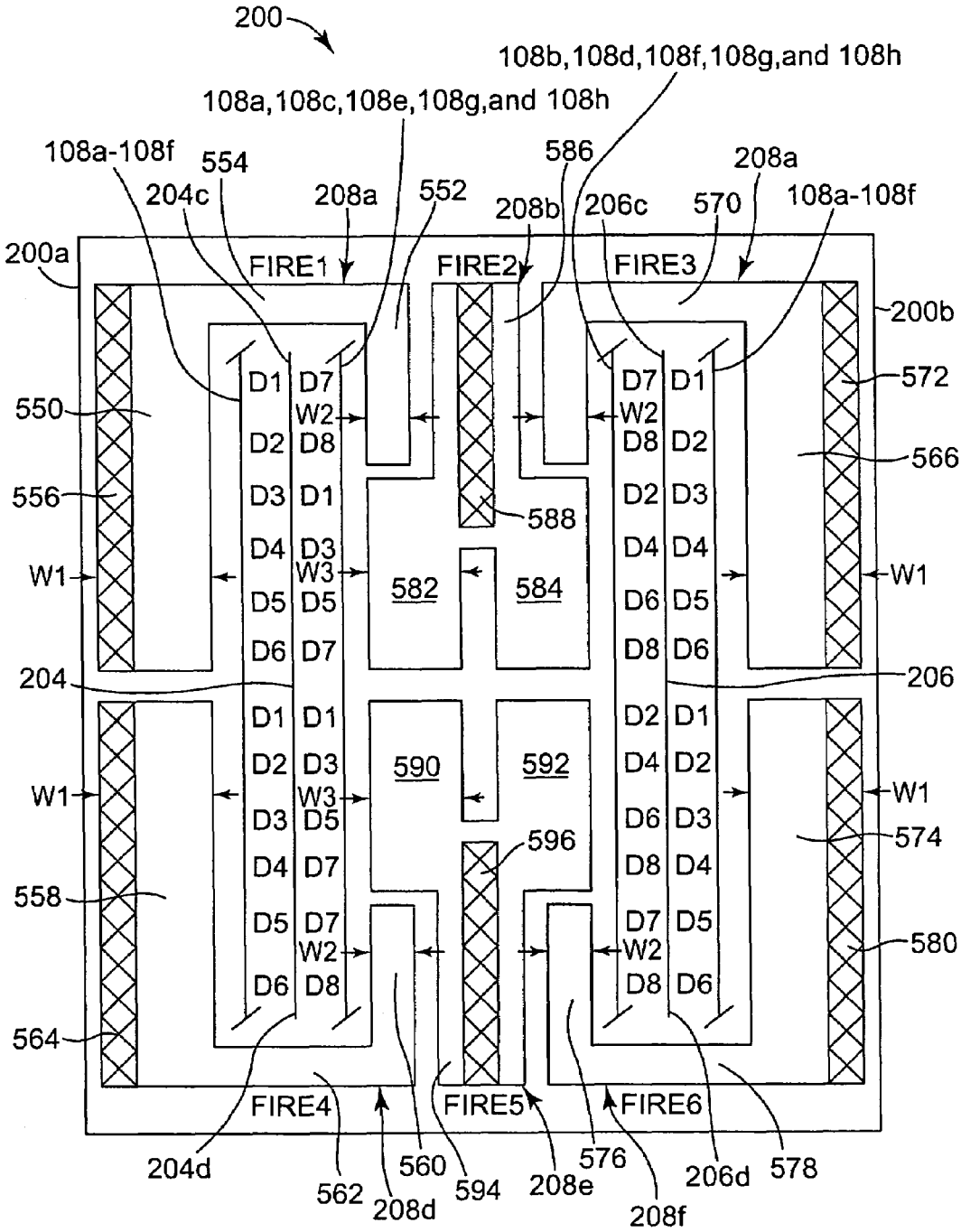
FIG. 11 is a block diagram illustrating a layout of fire lines in one embodiment of a printhead die.

FIG. 11 is a block diagram illustrating a layout of fire lines 208*a*-208*f* in one embodiment of printhead die 200. The printhead die 200 includes fire lines 208*a*-208*f*, data lines 108*a*-108*h* and ink feed slots 204 and 206. Each of the fire lines 208*a*-208*f* corresponds to one of the fire groups 202*a*-202*f* and is electrically coupled to all firing resistors 52 in the corresponding fire group 202*a*-202*f*. Each of the data lines 108*a*-108*h* corresponds to one of the data line groups 212, 214, 216, 218, 220, 222, 224 and 226 and is electrically coupled to all firing cells 70 in the corresponding data line group 212, 214, 216, 218, 220, 22, 224 and 226. Each of the data lines 108*a*-108*h* is electrically coupled to firing cells 70 in each of the fire groups 202*a*-202*f*.

Data lines 108*a*-108*h* receive data signals D1-D8 and supply the data signals D1-D8 to firing cells 70 in each of the fire groups 202*a*-202*f*. Data line 108*a* receives data signal D1 and supplies data signal D1 to data line group 212 in each of the fire groups 202*a*-202*f*. Data line 108*b* receives data signal D2 and supplies data signal D2 to data line group 214 in each of the fire groups 202*a*-202*f*. Data line 108*c* receives data signal D3 and supplies data signal D3 to data line group 216 in each of the fire groups 202*a*-202*f*. Data line 108*d* receives data signal D4 and supplies data signal D4 to data line group 218 in each of the fire groups 202*a*-202*f*. Data line 108*e* receives data signal D5 and supplies data signal D5 to data line group 220 in each of the fire groups 202*a*-202*f*. Data line 108*f* receives data signal D6 and supplies data signal D6 to data line group 222 in each of the fire groups 202*a*-202*f*. Data line 108*g* receives data signal D7 and supplies data signal D7 to data line group 224 in each of the fire groups 202*a*-202*f*. Data line 108*h* receives data signal D8 and supplies data signal D8 to data line group 226 in each of the fire groups 202*a*-202*f*.

The data lines 108*a*-108*h* are disposed along ink feed slots 204 and 206 in printhead die 200. Portions of data lines 108*a*-108*f* are disposed along ink feed slot 204 and between ink feed slot 204 and printhead die side 200*a*. Other portions of data lines 108*a*-108*f* are disposed along ink feed slot 206 and between ink feed slot 206 and printhead die side 200*b*. Also, portions of data lines 108*a*, 108*c*, 108*e*, 108*g* and 108*h* are disposed along ink feed slot 204, between ink feed slot 204 and ink feed slot 206 and portions of data lines 108*b*, 108*d*, 108*f*, 108*g* and 108*h* are disposed along ink feed slot 206, between ink feed slot 206 and ink feed slot 204.

The portions of data lines 108*a*-108*f* disposed between ink feed slot 204 and printhead die side 200*a* are electrically coupled to firing cells 70 in data lines groups 212*a*, 214*a*, 216*a*, 218*a*, 220*a* and 222*a* in FG1 at 202*a*, and to firing cells 70 in data line groups 212*d*, 214*d*, 216*d*, 218*d*, 220*d* and 222*d* in FG4 at 202*d*. Data line 108*a* is electrically coupled to firing cells 70 in data line groups 212*a* and 212*d*. Data line 108*b* is electrically coupled to firing cells 70 in data line groups 214*a* and 214*d*. Data line 108*c* is electrically coupled to firing cells 70 in data line groups 216*a* and 216*d*. Data line 108*d* is electrically coupled to firing cells 70 in data line groups 218*a* and 218*d*. Data line 108*e* is electrically coupled to firing cells in data line groups 220*a* and 220*d*. Data line 108*f* is electrically coupled to firing cells 70 in data line groups 222*a* and 222*d*.

The portions of data lines 108*a*-108*f* disposed between ink feed slot 206 and printhead die side 200*b* are electrically coupled to firing cells 70 in data line groups 212*c*, 214*c*, 216*c*, 218*c*, 220*c* and 222*c* in FG3 at 202*c* and to firing cells 70 in data line groups 212*f*, 214*f*, 216*f*, 218*f*, 220*f* and 222*f* in FG6 at 202*f*. Data line 108*a* is electrically coupled to firing cells 70 in data line groups 212*c* and 212*f*. Data line 108*b* is electrically coupled to firing cells 70 in data line groups 214*c* and 214*f*. Data line 108*c* is electrically coupled to firing cells in data line groups 216*c* and 216*f*. Data line 108*d* is electrically coupled to firing cells 70 in data line groups 218*c* and 218*f*. Data line 108*e* is electrically coupled to firing cells 70 in data line groups 220*c* and 220*f*. Data line 108*f* is electrically coupled to firing cells 70 in data line groups 222*c* and 222*f*.

The portions of data lines 108*a*, 108*c*, 108*e*, 108*g* and 108*h* disposed along ink feed slot 204, between ink feed slot 204 and ink feed slot 206, are electrically coupled to firing cells 70 in FG1 at 202*a*, FG2 at 202*b*, FG4 at 202*d* and FG5 at 202*e*. Data line 108*a* is electrically coupled to firing cells in data line groups 212*b* and 212*e*. Data line 108*c* is electrically coupled to firing cells 70 in data line groups 216*b* and 216*e*. Data line 108*e* is electrically coupled to firing cells 70 in data line groups 220*b* and 220*e*. Data line 108*g* is electrically coupled to firing cells 70 in data line groups 224*a*, 224*b*, 224*d* and 224*e*. Data line 108*h* is electrically coupled to firing cells 70 in data line groups 226*a* and 226*d*.

The portions of data lines 108*b*, 108*d*, 108*f*, 108*g* and 108*h* disposed along ink feed slot 206 and between ink feed slot 206 and ink feed slot 204 are electrically coupled to firing cells 70 in FG2 at 202*b*, FG3 at 202*c*, FG5 at 202*e* and FG6 at 202*f*. Data line 108*b* is electrically coupled to firing cells 70 in data line groups 214*b* and 214*e*. Data line 108*d* is electrically coupled to firing cells 70 in data line groups 218*b* and 218*e*. Data line 108*f* is electrically coupled to firing cells 70 in data line groups 222*b* and 222*e*. Data line 108*g* is electrically coupled to firing cells 70 in data line groups 224*c* and 224*f*, and data line 108*h* is electrically coupled to firing cells 70 in data line groups 226*b*, 226*c*, 226*e* and 226*f*.

The fire lines 208*a*-208*f* receive energy signals FIRE 1, FIRE 2, . . . FIRE6 and supply the energy signals FIRE 1, FIRE 2 . . . FIRE6 to firing cells 70 in fire groups 202*a*-202*f*. Fire line 208*a* receives energy signal FIRE 1 and supplies the energy signal FIRE 1 to all firing cells 70 in FG1 at 202*a*. Fire line 208*b* receives energy signal FIRE 2 and supplies the energy signal FIRE 2 to all firing cells 70 in FG2 at 202*b*. Fire line 208*c* receives energy signal FIRE 3 and supplies the energy signal FIRE 3 to all firing cells 70 in FG3 at 202*c*. Fire line 208*d* receives energy signal FIRE4 and supplies the energy signal FIRE4 to all firing cells 70 in FG4 at 202*d*. Fire line 208*e* receives energy signal FIRE5 and supplies the energy signal FIRE5 to all firing cells 70 in FG5 at 202*e*. Fire line 208*f* receives energy signal FIRE6 and supplies the energy signal FIRE6 to all firing cells 70 in FG6 at 202*f*.

Each fire line 208*a*-208*f* supplies energy to firing resistors 52 that are coupled to conducting drive switches 72. Energy is supplied to firing resistors 52 through the energy signals FIRE 1, FIRE 2, . . . FIRE6. The energy heats the firing resistors 52 to heat and eject ink from drop generators 60. Variations in the amount of energy supplied to firing resistors 52 can result in ink drops that are not uniform in size and shape, resulting in a distorted printed image. To uniformly eject ink, each fire line 208*a*-208*f* is configured to maintain a suitable energy variation between firing resistors 52.

Energy variation is the maximum percent difference in power dissipated through any two firing resistors 52 in one of the fire groups 202*a*-202*f*. The highest power is generally provided to the firing resistor 52 nearest the bond pad receiving the energy signal FIRE 1, FIRE 2, . . . FIRE6 as only a single firing resistor 52 is energized. The lowest power is generally provided to the firing resistor 52 that is the furthest from the bond pad receiving the energy signal FIRE 1, FIRE 2, . . . FIRE6 as all firing resistors 52 in a row subgroup are energized. Layout contributions to energy variation include fire line length, fire line width, fire line conductor thickness and ground line, e.g. reference conductor 250, dimensions. In an exemplary embodiment, the ground line portions, e.g. each of reference conductor portions 250*a*, 250*b*, 250*c*, and 250*d*, are less than 800 um wide, an in one embodiment about 96 μum wide. In this exemplary embodiment, fire lines may be between 50 and 500 um wide. These dimensions are for one exemplary embodiment; other embodiments may employ other sizes and dimensions. Energy variations of 10-15% are preferred and energy variations up to 20% have been found to be suitable energy variations.

The fire groups 202*a*-202*f* and fire lines 208*a*-208*f* are disposed in printhead die 200 to achieve a suitable energy variation between firing resistors 52. Instead of all firing cells 70 in one fire group 202*a*-202*f* being disposed along one side of one ink feed slot 204 or 206, resulting in a long fire line 208*a*-208*f*, the firing cells 70 in one fire group 202*a*-202*f* are disposed along opposing sides of one ink feed slot 204 or 206, or along both ink feed slots 204 and 206. This reduces the length of the corresponding fire line 208*a*-208*f*.

The firing cells 70 in fire group 202*a* are disposed along opposing sides of ink feed slot 204 and the firing cells 70 in fire group 202*d* are also disposed along opposing sides of ink feed slot 204. Each of the fire lines 208*a* and 208*d* is disposed along the opposing sides of ink feed slot 204 and joined at one end 204*c* or 204*d* of ink feed slot 204. Each fire line 208*a* and 208*d* is longer along one side of ink feed slot 204, as compared to along the other side of ink feed slot 204, to form substantially J-shaped fire lines 208*a* and 208*d*.

The firing cells 70 in fire group 202*c* are disposed along opposing sides of ink feed slot 206 and the firing cells 70 in fire group 202*f* are also disposed along opposing sides of ink feed slot 206. Each fire line 208*c* and 208*f* is disposed along opposing sides of ink feed slot 206 and joined at one end 206*c* or 206*d* of ink feed slot 206. Each fire line 208*c* and 208*f* is longer along one side of ink feed slot 206, as compared to along the other side of ink feed slot 206, to form substantially J-shaped fire lines 208*c* and 208*f*.

The firing cells 70 in fire group 202*b* are disposed along both ink feed slots 204 and 206, and the firing cells 70 in fire group 202*e* are disposed along both ink feed slots 204 and 206. Each fire line 208*b* and 208*e* is disposed along both ink feed slots 204 and 206 and joined between ink feed slots 204 and 206. Each fire line 208*b* and 208*e* includes a post section disposed between ink feed slots 204 and 206. The post section extends the fire line 208*b* and 208*e* to one side of printhead die 200 and forms substantially fork-shaped (or goal-post shaped) fire lines 208*b* and 208*e*. The substantially J-shaped and substantially fork-shaped fire lines 208*a*-208*f* can be shorter in length than fire lines that extend along only one side of one ink feed slot 204 or 206.

The substantially J-shaped fire line 208*a* is electrically coupled to firing cells 70 disposed along each of the opposing sides of ink feed slot 204. A first section, indicated at 550, is electrically coupled to firing cells 70 in six data line groups 212*a*, 214*a*, 216*a*, 218*a*, 220*a* and 222*a* in FG1 at 202*a*. A second section, indicated at 552, is electrically coupled to firing cells 70 in two data line groups 224*a* and 226*a* in FG1 at 202*a*. The first section 550 is electrically coupled to the second section 552 through a third section 554 at one end 204*c* of ink feed slot 204. The first section 550 is longer than the second section 552 in the y-direction along the length of ink feed slot 204.

The first section 550 supplies the energy signal FIRE 1 to up to six firing resistors 52 coupled to conducting drive switches 72. The second section 552 supplies the energy signal FIRE 1 to up to two firing resistors 52 coupled to conducting drive switches 72. The first section 550 is wider at W1 than the second section 552 at W2. The first section 550, second section 552 and third section 554 are formed as part of second metal layer. In addition, the first section 550 includes a dual layer metal section, indicated with cross-hatching at 556, formed as part of second metal layer electrically coupled to first metal layer along printhead die side 200*a*. The dual layer section 556 and the width W1 of first section 550 maintain a suitable energy variation between firing resistors 52.

The substantially J-shaped fire line 208*d* is electrically coupled to firing cells 70 disposed along each of the opposing sides of ink feed slot 204. A first section, indicated at 558, is electrically coupled to firing cells 70 in six data line groups 212*d*, 214*d*, 216*d*, 218*d*, 220*d* and 222*d* in FG4 at 202*d*. A second section, indicated at 560, is electrically coupled to firing cells 70 in two data line groups 224*d* and 226*d* in FG4 at 202*d*. The first section 558 is electrically coupled to the second section 560 through a third section 562 at one end 204*d* of ink feed slot 204. The first section 558 is longer than the second section 560 in the y-direction along the length of ink feed slot 204.

The first section 558 supplies the energy signal FIRE4 to up to six firing resistors 52 coupled to conducting drive switches 72. The second section 560 supplies the energy signal FIRE4 to up to two firing resistors 52 coupled to conducting drive switches 72. The first section 558 is wider at W1 than the second section 560 at W2. The first section 558, second section 560 and third section 562 are formed as part of second metal layer. In addition, the first section 558 includes a dual layer metal section, indicated with cross-hatching at 564, formed as part of second metal layer electrically coupled to first metal layer along printhead die side 200*a*. The dual layer section 564 and width W1 of first section 558 maintain a suitable energy variation between firing resistors 52.

The substantially J-shaped fire line 208*c* is electrically coupled to firing cells 70 disposed along each of the opposing sides of ink feed slot 206. A first section, indicated at 566, is electrically coupled to firing cells 70 in six data line groups 212*c*, 214*c*, 216*c*, 218*c*, 220*c* and 222*c* in FG3 at 202*c*. A second section, indicated at 568, is electrically coupled to firing cells 70 in two data line groups 224*c* and 226*c* in FG3 at 202*c*. The first section 566 is electrically coupled to the second section 568 through a third section 570 at one end 206*c* of ink feed slot 206. The first section 566 is longer than the second section 568 in the y-direction along the length of ink feed slot 206.

The first section 566 supplies the energy signal FIRE 3 to up to six firing resistors 52 coupled to conducting drive switches 72. The second section 568 supplies the energy signal FIRE 3 to up to two firing resistors 52 coupled to conducting drive switches 72. The first section 566 is wider at W1 than the second section 568 at W2. The first section 566, second section 568 and third section 570 are formed as part of second metal layer. In addition, the first section 566 includes a dual layer metal section, indicated with cross-hatching at 572, formed as part of second metal layer electrically coupled to first metal layer along printhead die side 200*b*. The dual layer section 572 and the width W1 of first section 566 maintain a suitable energy variation between firing resistors 52.

The substantially J-shaped fire line 208*f* is electrically coupled to firing cells 70 disposed along each of the opposing sides of ink feed slot 206. A first section, indicated at 574, is electrically coupled to firing cells 70 in six data line groups 212*f*, 214*f*, 216*f*, 218*f*, 220*f* and 222*f* in FG6 at 202*f*. A second section, indicated at 576, is electrically coupled to firing cells 70 in two data line groups 224*f* and 226*f* in FG6 at 202*f*. The first section 574 is electrically coupled to the second section 576 through a third section 578 at one end 206*d* of ink feed slot 206. The first section 574 is longer than the second section 576 in the y-direction along the length of ink feed slot 206.

The first section 574 supplies the energy signal FIRE6 to up to six firing resistors 52 coupled to conducting drive switches 72. The second section 576 supplies the energy signal FIRE6 to up to two firing resistors 52 coupled to conducting drive switches 72. The first section 574 is wider at W1 than the second section 576 at W2. The first section 574, second section 576 and third section 578 are formed as part of second metal layer. In addition, the first section 574 includes a dual layer metal section, indicated with cross-hatching at 580, formed as part of second metal layer electrically coupled to first metal layer along printhead die side 200*b*. The dual layer section 580 and width W1 of first section 574 maintain a suitable energy variation between firing resistors 52.

The substantially fork-shaped fire line 208*b* is electrically coupled to firing cells 70 disposed along each ink feed slot 204 and 206. A first section, indicated at 582, is electrically coupled to firing cells 70 in four data line groups 212*b*, 216*b*, 220*b* and 224*b* in FG2 at 202*b*. The second section, indicated at 584, is electrically coupled to firing cells 70 in four data line groups 214*b*, 218*b*, 222*b* and 226*b* in FG2 at 202*b*. The first section 582 is electrically coupled to the second section 584 through a third section or post section 586. The first section 582 is similar in length along the y-direction and width along the x-direction to the second section 584.

The first section 582 supplies the energy signal FIRE 2 to up to four firing resistors 52 coupled to conducting drive switches 72. The second section 584 supplies the energy signal FIRE 2 to up to four firing resistors 52 coupled to conducting drive switches 72. The first section 582 and the second section 584 are formed as part of second metal layer and are wider at W3 than the section width W2.

The third section 586 supplies the energy signal FIRE 2 to up to eight firing resistors 52 coupled to conducting drive switches 72. The third section 586 is formed as part of second metal layer and includes a post dual layer metal section, indicated with cross-hatching at 588. The post dual layer metal section at 588 includes second metal layer electrically coupled to first metal layer. The post dual layer metal section 588 and the width W3 of first and second sections 582 and 584 maintain a suitable energy variation between the firing resistors 52.

The substantially fork-shaped fire line 208*e* is electrically coupled to firing cells 70 disposed along each ink feed slot 204 and 206. A first section, indicated at 590, is electrically coupled to firing cells 70 in four data line groups 212*e*, 216*e*, 220*e* and 224*e* in FG5 at 202*e*. The second section, indicated at 592, is electrically coupled to firing cells 70 in four data line groups 214*e*, 218*e*, 222*e* and 226*e* in FG5 at 202*e*. The first section 590 is electrically coupled to the second section 592 through a third section or post section 594. The first section 590 is similar in length along the y-direction and width along the x-direction to the second section 592.

The first section 590 supplies the energy signal FIRE5 to up to four firing resistors 52 coupled to conducting drive switches 72. The second section 592 supplies the energy signal FIRE5 to up to four firing resistors 52 coupled to conducting drive switches 72. The first section 590 and the second section 592 are formed as part of second metal layer and are wider at W3 than the section width W2.

The third section 594 supplies the energy signal FIRE5 to up to eight firing resistors 52 coupled to conducting drive switches 72. The third section 594 is formed as part of second metal layer and includes a post dual layer metal section, indicated with cross-hatching at 596. The post dual layer metal section at 596 includes second metal layer electrically coupled to first metal layer. The post dual layer metal section 596 and the width W3 of first and second sections 590 and 592 maintain a suitable energy variation between the firing resistors 52.

Figure 12:
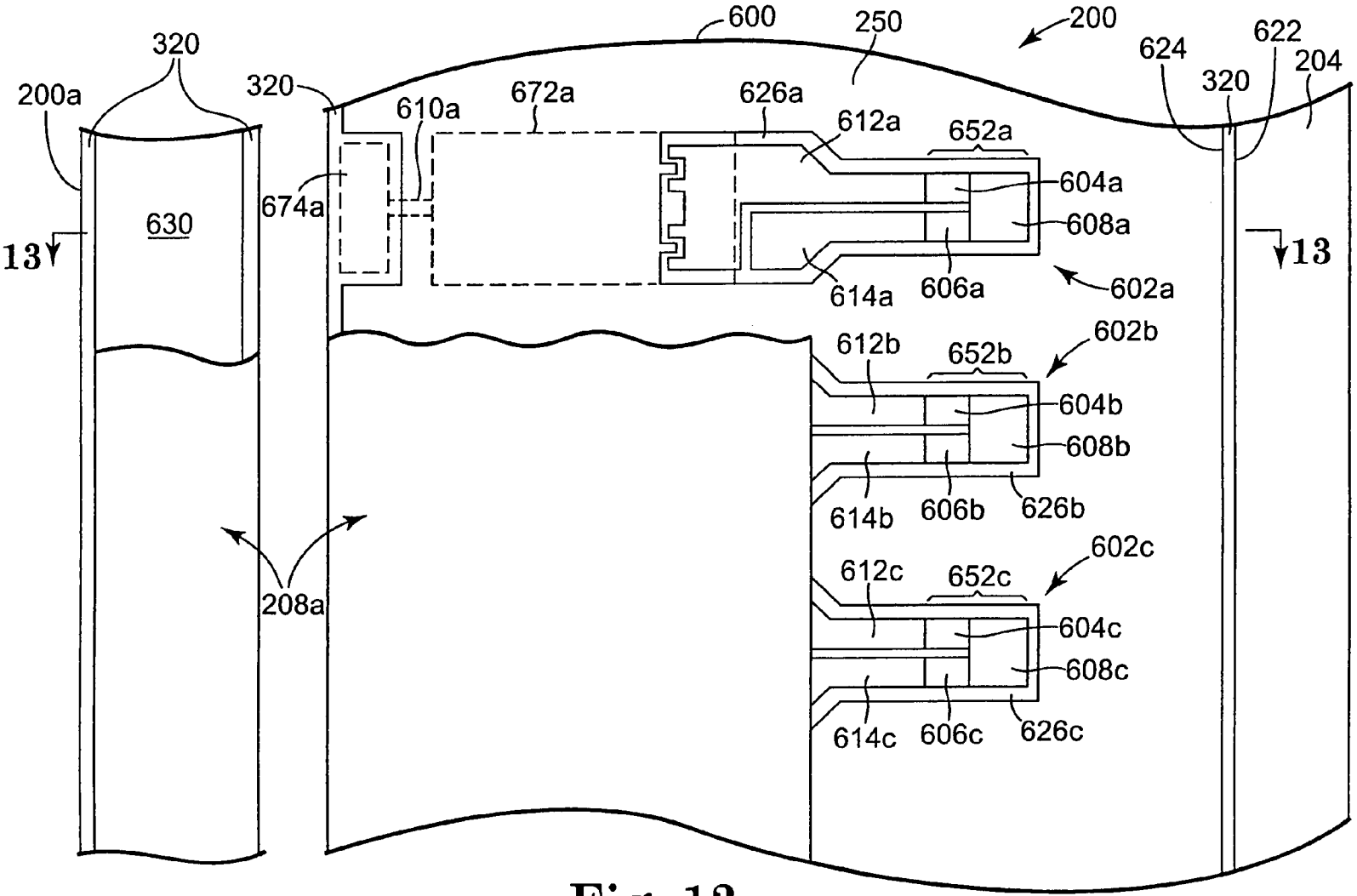
FIG. 12 is a plan view diagram illustrating one embodiment of a section of a printhead die.

FIG. 12 is a plan view diagram illustrating one embodiment of a section 600 of printhead die 200. The section 600 includes three firing cells, indicated at 602*a*-602*c*, ink feed slot 204, reference conductor 250 and fire line 208*a*. The three firing cells 602*a*-602*c* are similar to firing cells 70 that are disposed throughout printhead die 200 and instances of firing cells 70 that are part of data line group D1 at 212*a* in FG1 at 202*a*. The firing cells 602*a*-602*c* include firing resistors 52, memory circuits 74 and drive switches 72, such as firing resistors 652*a*-652*c* memory circuit 674*a* and drive switch 672*a*. The fire line 208*a* has been cut away to reveal firing cell 602*a*.

The firing cell 602*a* includes memory circuit 674*a*, drive switch 672*a* and firing resistor 652*a*. The firing resistor 652*a* includes a first resistive segment 604*a*, a second resistive segment 606*a* and a conductive shorting bar 608*a*. The first resistive segment 604*a* and second resistive segment 606*a* are separate resistive segments electrically coupled together through conductive shorting bar 608*a*. The memory circuit 674*a* is electrically coupled to the gate of drive switch 672*a* through a substrate lead 610*a*. One side of the drain-source path of drive switch 672*a* is electrically coupled to reference conductor 250. The reference conductor 250 contacts drive switch 672*a* where the reference conductor 250 is disposed over drive switch 672*a*. The other side of the drain-source path of drive switch 672*a* is electrically coupled to a drive switch conductive lead 612*a* that electrically couples the drain-source path of drive switch 672*a* to first resistive segment 604*a*. The second resistive segment 606*a* is electrically coupled to fire line 208*a* through fire line conductive lead 614*a*.

The firing cell 602*b* includes a memory circuit and drive switch disposed under fire line 208*a* and a firing resistor 652*b* that is not disposed under fire line 208*a*. The firing resistor 652*b* includes a first resistive segment 604*b*, a second resistive segment 606*b* and a conductive shorting bar 608*b*. The first resistive segment 604*b* and second resistive segment 606*b* are separate resistive segments electrically coupled together through conductive shorting bar 608*b*. The memory circuit and drive switch of firing cell 602*b* are electrically coupled together through a substrate lead and one side of the drain-source path of the drive switch is electrically coupled to reference conductor 250. The reference conductor 250 contacts the drive switch where the reference conductor 250 is disposed over the drive switch. The other side of the drain-source path of the drive switch is electrically coupled to a drive switch conductive lead 612*b* that electrically couples the drain-source path of the drive switch to first resistive segment 604*b*. The second resistive segment 606*b* is electrically coupled to fire line 208*a* through fire line conductive lead 614*b*.

The firing cell 602*c* includes a memory circuit and drive switch disposed under fire line 208*a* and a firing resistor 652*c* that is not disposed under fire line 208*a*. The firing resistor 652*c* includes a first resistive segment 604*c*, a second resistive segment 606*c* and a conductive shorting bar 608*c*. The first resistive segment 604*c* and second resistive segment 606*c* are separate resistive segments electrically coupled together through conductive shorting bar 608*c*. The memory circuit and drive switch of firing cell 602*c* are electrically coupled together through a substrate lead and one side of the drain-source path of the drive switch is electrically coupled to reference conductor 250. The reference conductor 250 contacts the drive switch where the reference conductor 250 is disposed over the drive switch. The other side of the drain-source path of the drive switch is electrically coupled to a drive switch conductive lead 612*c* that electrically couples the drain-source path of the drive switch to first resistive segment 604*c*. The second resistive segment 606*c* is electrically coupled to fire line 208*a* through fire line conductive lead 614*c*.

The firing cells 602*a*-602*c* are formed in and on semiconductor substrate 320 of printhead die 200. The memory circuits 74, such as memory circuit 674*a*, drive switches 72, such as drive switch 672*a*, and substrate leads, such as substrate lead 610*a*, are formed in substrate 320 of printhead die 200. The reference conductor 250, drive switch conductive leads 612*a*-612*c*, fire line conductive leads 614*a*-614*c* and shorting bars 608*a*-608*c* are formed as part of the first metal layer that is formed on substrate 320. In addition, first resistive segments 604*a*-604*c* and second resistive segments 606*a*-606*c* are formed as part of a resistive layer.

The ink feed slot 204 is formed in substrate 320 and provides ink to firing resistors 652*a*-652*c*. The ink feed slot 204 includes an ink feed slot edge 622 at the surface of substrate 320. The ink feed slot edge 622 is in communication with the surface of substrate 320 along the length of ink feed slot 204. The reference conductor 250 is disposed along ink feed slot 204 and spaced apart from ink feed slot edge 622 and is formed as part of first metal layer at 624. Opposing side 204*a* of the ink feed slot 204 includes ink feed slot edge 622 and opposing side 204*b* of ink feed slot 204 includes an ink feed slot edge similar to ink feed slot edge 622. In addition, each of the opposing sides 206*a* and 206*b* of ink feed slot 206 includes an ink feed slot edge in communication with the surface of substrate 320 and similar to ink feed slot edge 622.

The reference conductor 250 is formed as part of the first metal layer and disposed between memory circuits 74, such as memory circuit 74*a*, and ink feed slot 204. The drive switch conductive leads 612*a*-612*c*, fire line conductive leads 614*a*-614*c* and firing resistors 652*a*-652*c* are isolated from reference conductor 250 and disposed in firing resistor areas 626*a*-626*c*. Firing resistor area 626*a* includes drive switch conductive lead 612*a*, fire line conductive lead 614*a* and firing resistor 652*a*. Firing resistor area 626*b* includes drive switch conductive lead 612*b*, fire line conductive lead 614*b* and firing resistor 652*b*. Firing resistor area 626*c* includes drive switch conductive lead 612*c*, fire line conductive lead 614*c* and firing resistor 652*c*.

The reference conductor 250 is disposed over a portion of each of the drive switches 72 and between memory circuit 74 and firing resistor areas 626*a*-626*c*. The reference conductor 250 is also disposed between ink feed slot edge 622 and firing resistor areas 626*a*-626*c*. In addition, the reference conductor 250 is disposed between firing resistor areas 626*a*-626*c*. The reference conductor 250 is substantially planar between memory circuit 74 and ink feed slot edge 322. The reference conductor 250 has a larger or increased area due to the portion of reference conductor 250 that is disposed between ink feed slot edge 622 and firing resistor areas 626*a*-626*c*. The larger area reference conductor 250 reduces the energy variation between firing cells and provides a more uniform ink pattern.

The fire line 208*a* includes a second metal layer that is disposed over portions of the firing resistor areas 626*a*-626*c* and disposed from the firing resistor areas 626*a*-626*c* to one side 200*a* of printhead die 200. The second metal layer of fire line 208*a* is disposed over portions of drive switch conductive leads 612*a*-612*c* and fire line conductive leads 614*a*-614*c*, and electrically coupled to fire line conductive leads 614*a*-614*c* through vias from the second metal layer to the first metal layer. The second metal layer of fire line 208*a* is also disposed over portions of the reference conductor 250 disposed between the firing resistor areas 626*a*-626*c* and memory circuits 74. In addition, the second metal layer of fire line 208*a* is disposed over enable and data lines routed in the first metal layer between the reference conductor 250 and the one side 200*a* of printhead die 200. The fire line 208*a* includes a dual layer section at 556 that includes the first metal layer at 630 electrically coupled through a via to the second metal layer of fire line 208*a*. The dual layer section at 556 is disposed along one side 200*a* of printhead die 200.

In operation, one of the firing cells 602*a*-602*c* is fired or energized at a time. In one example operation, memory circuit 674*a* provides a voltage level on the gate of drive switch 672*a* to turn drive switch 672*a* on or off. Fire line 208*a* receives energy signal FIRE 1 and provides an energy pulse to second resistive segment 606*a* through fire line conductive lead 614*a*.

If drive switch 672*a* is conducting, the energy pulse provides a current through firing resistor 652*a*, drive switch conductive lead 612*a* and drive switch 672*a* to reference conductor 250. With reference conductor 250 electrically coupled to a reference voltage, for example ground, the current flows through reference conductor 250 to ground.

The layout of firing cells 602*a*-602*c* in section 600 is similar to the layout of firing cells 70 along ink feed slots 204 and 206 throughout printhead die 200. In addition, the layout of fire line 208*a* and reference conductor 250 in section 600 is similar to the layout of fire lines 208 and reference conductor 250 throughout printhead die 200.

Figure 13:
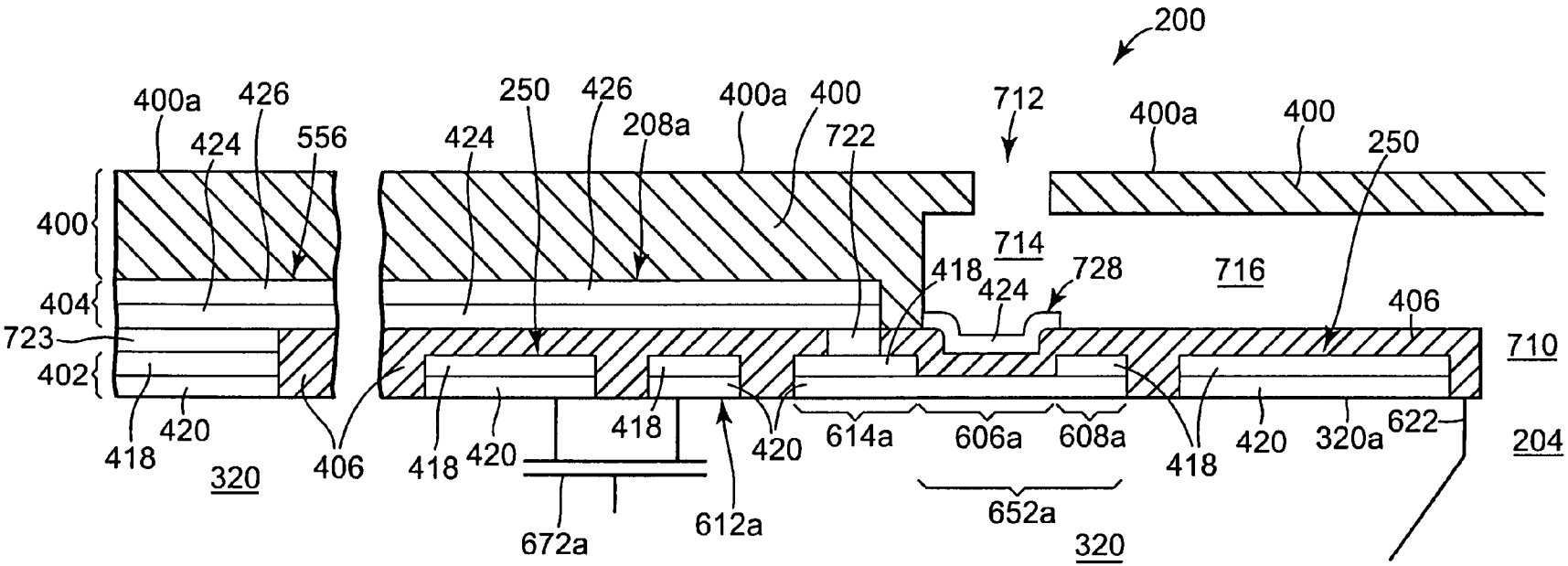
FIG. 13 is a diagram illustrating a partial cross-section of one embodiment of a printhead die taken at the position of line 13 in FIG. 12.

FIG. 13 is a diagram illustrating a partial cross-section of one embodiment of printhead die 200 taken at the position of line 13 in FIG. 12. FIG. 13 is not drawn to scale for clarity. The partial cross-section includes orifice layer 400, second metal layer 404, isolation layer 406, first metal layer 402 and substrate 320. Drive switch 672*a* and ink feed slot 204 are formed in substrate 320 that includes a substrate surface 320*a*. The ink feed slot 204 includes ink feed slot edge 622 in communication with substrate surface 320*a*. The first metal layer 402 is formed on substrate surface 320*a*. Isolation layer 406 is formed on first metal layer 402 and substrate surface 320*a* and defines ink feed channel 710.

The orifice layer 400 has a front face 400*a* and a nozzle opening 712 in the front face 400*a*. Orifice layer 400 also has a nozzle chamber or vaporization chamber 714 and a fluid path or ink feed path 716 formed therein. The firing resistor, indicated at 652*a*, is located at least partially under vaporization chamber 714, which is between firing resistor 652*a* and nozzle opening 712. The ink feed path 716 is located between vaporization chamber 714 and ink feed channel 710. The vaporization chamber 714 communicates with nozzle opening 712 and ink feed path 716. The ink feed path 716 communicates with vaporization chamber 714 and ink feed channel 710 that communicates with ink feed slot 204. The ink feed slot 204 supplies ink to vaporization chamber 714 through ink feed channel 710 and ink feed path 716.

The first metal layer 402 is formed on substrate 320 and insulated from second metal layer 404 by isolation layer 406. The first metal layer includes a conductive layer 418 and a resistive layer 420. The conductive layer 418 is made of a suitable conductive material, for example aluminum-copper, and the resistive layer 420 is made of a suitable resistive material, for example tantalum-aluminum. The first metal layer 402 includes in one embodiment multiple leads and components, including reference conductor 250, drive switch conductive lead 612*a*, fire line conductive lead 614*a*, firing resistor 652*a* and a portion of fire line 208*a*.

The firing resistor 652*a* is made from first metal layer 402 and includes second resistive segment 606*a* and shorting bar 608*a*. The second resistive segment 606*a* includes resistive layer 420. Conductive layer 418 is not disposed on second resistive segment 606*a*. The shorting bar 608*a* includes conductive layer 418 and resistive layer 420. The second resistive segment 606*a* is electrically coupled to shorting bar 608*a* and fire line conductive lead 614*a*.

The fire line conductive lead 614*a* is made from first metal layer 402 and includes conductive layer 418 and resistive layer 420. The fire line conductive lead 614*a* is electrically coupled to second metal layer 404 through via 722 formed in isolation layer 406. The via 722 in isolation layer 406 is filled with conductive material to electrically couple fire line conductive lead 614*a* to second metal layer 404.

The reference conductor 250 is disposed on substrate 320 over a portion of drive switch 672*a* and between firing resistor 652*a* and ink feed slot edge 622. The reference conductor 250 is electrically coupled to one side of the drain-source path of drive switch 672*a*. The other side of the drain-source path of drive switch 672*a* is electrically coupled to drive switch conductive lead 612*a* that is electrically coupled to first resistive segment 604*a* of firing resistor 652*a*. The reference conductor 250 and drive switch conductive lead 612*a* are formed as part of first metal layer 402 and include conductive layer 418 and resistive layer 420.

The isolation layer 406 is an insulating passivation layer disposed over first metal layer 402, including reference conductor 250 and firing resistor 652*a*. The isolation layer 406 defines ink feed channel 710 and is disposed along ink feed slot edge 622. The isolation layer 406 covers reference conductor 250 between firing resistor 652*a* and ink feed slot edge 622 and prevents ink from touching and corroding reference conductor 250. The isolation layer 406 is also disposed over shorting bar 608*a* and second resistive segment 606*a* and prevents ink from touching and corroding shorting bar 608*a* and second resistive segment 606*a*. In addition, isolation layer 406 is disposed over fire line conductive lead 614*a*, drive switch conductive lead 612*a* and reference conductor 250 situated over drive switch 672*a*. The via 722 is etched in isolation layer 406 to electrically couple fire line conductive lead 614*a* to second metal layer 404. A via 723 is etched in isolation layer 406 and filled with a conductive material to electrically couple second metal layer 404 to first metal layer 402 to form dual layer section 556. The isolation layer 406 is formed as part of a suitable insulating material. In one embodiment, isolation layer 406 includes two layers, for example, a silicon-carbide layer and a silicon-nitride layer.

A portion of fire line 208*a* is formed in second metal layer 404 and is electrically coupled through via 722 to fire line conductive lead 614*a*. The second metal layer 404 includes a first layer 424, made from a suitable material, for example tantalum, and a second layer 426 made from a suitable conductive material, for example gold. The first layer 424 is disposed to make contact with fire line conductive lead 614*a* through via 722. The first layer 424 is also disposed to make contact with first metal layer 402 through via 723 to form the dual layer section 556 of fire line 208*a*. In addition, the first layer 424 is disposed at 728 on isolation layer 406 over second resistive segment 606*a*. The first layer 424 at 728 protects isolation layer 406 as ink is heated by firing resistor 652*a*. The second layer 426 is a conductive gold layer disposed on first layer 424 to form a portion of fire line 208*a*. The fire line 208*a* receives energy signal FIRE 1 and supplies energy pulses to fire line conductive lead 614*a* and second resistive segment 606*a*, through firing resistor 652*a* to heat and eject ink from vaporization chamber 714 through nozzle 712.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device comprising:

a substrate;

a first fluid feed slat formed in the substrate and having a first fluid feed slot edge;

first firing resistors disposed along the first fluid feed slot and first nozzle openings each associated with one of the first firing resistors, wherein the first firing resistors are configured to respond to a first current to heat fluid provided by the first fluid feed slot via a fluid path and eject the fluid from the associated one of the first nozzle openings;

first conductive leads extending to respective ones of the first firing resistors, and second conductive leads extending from respective ones of the first firing resistors; and a reference conductor formed on the substrate and configured to conduct the first current from the first firing resistors, wherein the reference conductor is disposed between adjacent ones of the first firing resistors as associated with respective ones of the first nozzle openings, between the first conductive leads and the second conductive loads of one of the first firing resistors and the first conductive leads and the second conductive leads of an adjacent one of the first firing resistors, and under the fluid path in an area between the first fluid feed slot edge and the first firing resistors.

2. The fluid ejection device of claim 1, comprising drive switches, wherein each of the drive switches is electrically coupled to a corresponding first firing resistor of the first firing resistors and the reference conductor is disposed over a portion of the drive switches.

3. The fluid ejection device of claim 1, comprising drive switches formed in a first layer and firing resistor areas formed in a second layer disposed along the first fluid feed slot, wherein the reference conductor is disposed between adjacent firing resistor areas and over a portion of the drive switches.

4. The fluid ejection device of claim 1, comprising drive switches, wherein each of the drive switches is electrically connected to a corresponding first firing resistor of the first firing resistors and the reference conductor.

5. The fluid ejection device of claim 1, comprising drive switches, wherein each of the drive switches is a field effect transistor that is electrically connected between a corresponding first firing resistor and the reference conductor.

6. The fluid ejection device of claim 1, wherein the reference conductor is disposed along the entire length of the first fluid feed slot.

7. The fluid ejection device of claim 1, wherein the reference conductor is disposed along opposing sides of the first fluid feed slot and along the entire length of the opposing sides of the first fluid feed slot.

8. The fluid ejection device of claim 1, wherein the first firing resistors are disposed along opposing sides of the first fluid feed slot and the reference conductor is disposed between the first firing resistors and the first fluid feed slot edge along one of the opposing sides of the first fluid feed slot and the first firing resistors and a second fluid feed slot edge along another one of the opposing sides of the first fluid feed slot.

9. The fluid ejection device of claim 1, comprising second firing resistors disposed along the first fluid feed slot and configured to respond to a second current to heat fluid provided by the first fluid feed slot, wherein the reference conductor is configured to conduct the second current from the second firing resistors and the reference conductor is disposed between the first fluid feed slot edge and the second firing resistors.

10. The fluid ejection device of claim 9, wherein the second firing resistors are disposed on opposing sides of the first fluid feed slot and the reference conductor is disposed between the second firing resistors and the first fluid feed slot edge along one of the opposing sides of the first fluid feed slot and the second firing resistors and a second fluid feed slot edge along another one of the opposing sides of the first fluid feed slot.

11. The fluid ejection device of claim 9, comprising a second fluid feed slot and third firing resistors disposed along the second fluid feed slot and configured to respond to a third current to heat fluid provided by the second fluid feed slot, wherein the reference conductor is configured to conduct the third current from the third firing resistors, and the reference conductor is disposed between the third firing resistors and a second fluid feed slot edge along the second fluid feed slot.

12. The fluid ejection device of claim 11, wherein the third firing resistors are disposed on opposing sides of the second fluid feed slot and the reference conductor is disposed between the third firing resistors and the second fluid feed slot edge along one of the opposing sides of the second fluid feed slot and the third firing resistors and a third fluid feed slot edge along another one of the opposing sides of the second fluid feed slot.

13. The fluid ejection device of claim 11, comprising fourth firing resistors disposed along the second fluid feed slot and configured to respond to a fourth current to heat fluid provided by the second fluid feed slot, wherein the reference conductor is configured to conduct the fourth current from the fourth firing resistors and the reference conductor is disposed between the second fluid feed slot edge and the fourth firing resistors.

14. The fluid ejection device of claim 13, wherein the fourth firing resistors are disposed on opposing sides of the second fluid feed slot and the reference conductor is disposed between the fourth firing resistors and the second fluid feed slot edge along one of the opposing sides of the second fluid feed slot and the fourth firing resistors and a third fluid feed slot edge along another one of the opposing sides of the second fluid feed slot.

15. The fluid ejection device of claim 13, comprising fifth firing resistors, wherein a first portion of the fifth firing resistors are disposed along the first fluid feed slot and configured to respond to a fifth current to heat fluid provided by the first fluid feed slot and a second portion of the fifth firing resistors are disposed along the second fluid feed slot and configured to respond to the fifth current to heat fluid provided by the second fluid feed slot, wherein the reference conductor is configured to conduct the fifth current from the fifth firing resistors and is disposed between the first fluid feed slot edge and the first portion of the fifth firing resistors and between the second fluid feed slot edge and the second portion of the fifth firing resistors.

16. The fluid ejection device of claim 15, comprising sixth firing resistors, wherein a first portion of the sixth firing resistors are disposed along the first fluid feed slot and configured to respond to a sixth current to heat fluid provided by the first fluid feed slot and a second portion of the sixth firing resistors are disposed along the second fluid feed slot and configured to respond to the sixth current to heat fluid provided by the second fluid feed slot, wherein the reference conductor is configured to conduct the sixth current from the sixth firing resistors and is disposed between the first fluid feed slot edge and the first portion of the sixth firing resistors and between the second fluid feed slot edge and the second portion of the sixth firing resistors.

17. The fluid ejection device of claim 1, comprising a second fluid feed slot having a second fluid feed slot edge and second firing resistors, wherein a first portion of the second firing resistors are disposed along the first fluid feed slot and configured to respond to a second current to heat fluid provided by the first fluid feed slot and a second portion of the second firing resistors are disposed along the second fluid feed slot and configured to respond to the second current to heat fluid provided by the second fluid feed slot, wherein the reference conductor is configured to conduct the second current from the second firing resistors and is disposed between the first fluid feed slot edge and the first portion of the second firing resistors and between the second fluid feed slot edge and the second portion of the second firing resistors.

18. The fluid ejection device of claim 1, wherein the reference conductor comprises a conductive layer and a resistive layer.

19. The fluid ejection device of claim 1, comprising:

vaporization chambers fluidically coupled to the first fluid feed slot; and an isolation layer configured to isolate the reference conductor from fluid flowing from the fluid feed slot to the vaporization chambers, wherein the reference conductor is disposed between adjacent vaporization chambers and between the vaporization chambers and the first fluid feed slot edge.

20. The fluid ejection device of claim 1, wherein each of the first firing resistors includes a first resistive segment, a second resistive segment, and a conductive shorting bar electrically coupled to the first resistive segment and the second resistive segment.

21. The fluid ejection device of claim 20, wherein a respective one of the first conductive leads is electrically coupled to the first resistive segment of a respective one of the first firing resistors, and wherein a respective one of the second conductive leads is electrically coupled to the second resistive segment of the respective one of the first firing resistors.

22. A method of operating a fluid ejection device, comprising:

receiving fluid via a fluid path at first firing resistors disposed along a first fluid feed slot formed in a substrate, the first fluid feed slot having a first fluid feed slot edge and the fluid path extending between the first fluid feed slot edge and the first firing resistors; receiving a first current at the first firing resistors via first conductive leads extending to respective ones of the first firing resistors;

heating the fluid received from the first fluid feed slot in response to receiving the first current at the first firing resistors and ejecting the fluid from respective first nozzle openings each associated with one of the first firing resistors;

receiving the first current from the first firing resistors at a reference conductor via second conductive leads extending from respective ones of the first firing resistors, the reference conductor formed on the substrate between adjacent ones of the first firing resistors as associated with respective ones of the first nozzle openings, between the first conductive leads and the second conductive leads extending to and from one of the first firing resistors and the first conductive leads and the second conductive leads extending to and from an adjacent one of the first firing resistors, and under the fluid path in an area between the first fluid feed slot edge and the first firing resistors; and conducting part of the first current through the reference conductor as disposed between the adjacent ones of the first firing resistors, between the first conductive leads and the second conductive leads extending to and from one of the first firing resistors and the first conductive leads and the second conductive leads extending to and from an adjacent one of the first firing resistors, and between the first fluid feed slot edge and the first firing resistors.

23. The method of claim 22, comprising:

gating the first current through drive switches; and conducting a second part of the first current through the reference conductor as disposed over a portion of the drive switches.

24. The method of claim 23, comprising conducting the second part of the first current through the reference conductor along the entire length of the first fluid feed slot.

25. The method of claim 23, comprising receiving the first current from the first firing resistors on opposing sides of the first fluid feed slot.

26. The method of claim 23, comprising:

receiving a second current at second firing resistors disposed along the first fluid feed slot;

heating the fluid received from the first fluid feed slot in response to receiving the second current at the second firing resistors;

receiving the second current from the second firing resistors at the reference conductor; and conducting part of the second current through the reference conductor as disposed between the first fluid feed slot edge and the second firing resistors.

27. The method of claim 26, comprising:

receiving fluid via a second fluid path at second firing resistors disposed along a second fluid feed slot formed in the substrate, the second fluid feed slot having a second fluid feed slot edge and the second fluid path extending between the second fluid feed slot edge and the second firing resistors;

receiving the first current at the second firing resistors;

heating the fluid received from the second fluid feed slot in response to receiving the first current at the second firing resistors;

receiving the first current from the second firing resistors at the reference conductor as formed on the substrate under the second fluid path in an area between the second fluid feed slot edge and the second firing resistors; and conducting a second part of the first current through the reference conductor as disposed between the second fluid feed slot edge and the second firing resistors.

28. The method of claim 23, comprising:

receiving fluid via a second fluid path at second firing resistors disposed along a second fluid feed slot formed in the substrate, the second fluid feed slot having a second fluid feed slot edge and the second fluid path extending between the second fluid feed slot edge and the second firing resistors;

receiving a second current at the second firing resistors;

heating the fluid received from the second fluid feed slot in response to receiving the second current at the second firing resistors;

receiving the second current from the second firing resistors at the reference conductor as formed on the substrate under the second fluid path in an area between the second fluid feed slot edge and the second firing resistors; and conducting part of the second current through the reference conductor as disposed between the second fluid feed slot edge and the second firing resistors.

29. The method of claim 22, wherein each of the first firing resistors includes a first resistive segment, a second resistive segment, and a conductive shorting bar electrically coupled to the first resistive segment and the second resistive segment.

30. The method of claim 29, wherein a respective one of the first conductive leads is electrically coupled to the first resistive segment of a respective one of the first firing resistors, and wherein a respective one of the second conductive leads is electrically coupled to the second resistive segment of the respective one of the first firing resistors.

31. A fluid ejection device comprising:

a substrate;

a fluid feed slot formed in the substrate;

vaporization chambers fluidically coupled to the fluid feed slot via a fluid path;

nozzle openings each communicated with a respective one of the vaporization chambers;

firing resistors disposed in the vaporization chambers;

first conductive leads extending to respective ones of the firing resistors and second conductive leads extending from respective ones of the firing resistors; and a reference conductor disposed between adjacent ones of the firing resistors as communicated with respective ones of the nozzle openings, between the first conductive leads and the second conductive leads extending to and from one of the firing resistors and the first conductive leads and the second conductive leads extending to and from an adjacent one of the firing resistors, and under the fluid path in an area between an edge of the fluid feed slot and the vaporization chambers.

32. The fluid ejection device of claim 31 comprising:

an isolation structure configured to isolate the reference conductor from fluid flowing through the fluid path.

33. The fluid ejection device of claim 31, wherein each of the firing resistors includes a first resistive segment, a second resistive segment, and a conductive shorting bar electrically coupled to the first resistive segment and the second resistive segment.

34. The fluid ejection device of claim 33, wherein a respective one of the first conductive leads is electrically coupled to the first resistive segment of a respective one of the firing resistors, and wherein a respective one of the second conductive leads is electrically coupled to the second resistive segment of the respective one of the firing resistors.

* * * * *

UNITED STATES PATENT AND TRADEMARK OFFICE

CERTIFICATE OF CORRECTION

PATENT NO. : 7,488,056 B2
APPLICATION NO. : 10/827030
DATED : February 10, 2009
INVENTOR(S) : Joseph M Torgerson et al.

It is certified that error appears in the above-identified patent and that said Letters Patent is hereby corrected as shown below:

In column 28, line 51, in Claim 1, delete “slat” and insert -- slot --, therefor.

In column 29, line 2, in Claim 1, delete “loads” and insert -- leads --, therefor.

Signed and Sealed this

Twenty-sixth Day of May, 2009

John Doll

JOHN DOLL
*Acting Director of the United States Patent and Trademark Office*